US007233764B2

(12) United States Patent
Naito et al.

(10) Patent No.: US 7,233,764 B2
(45) Date of Patent: Jun. 19, 2007

(54) FIXING DEVICE IN IMAGE FORMING APPARATUS AND IMAGE FORMING APPARATUS WITH FIXING DEVICE

(75) Inventors: Yasutaka Naito, Kanagawa (JP); Hideaki Ohhara, Kanagawa (JP); Yasuhiro Uehara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/211,692

(22) Filed: Aug. 26, 2005

(65) Prior Publication Data

US 2006/0182474 A1 Aug. 17, 2006

(30) Foreign Application Priority Data

Feb. 15, 2005 (JP) ..... P2005-038078

(51) Int. Cl.
*G03G 15/20* (2006.01)

(52) U.S. Cl. ..... 399/329; 399/324; 399/325; 399/326; 399/328

(58) Field of Classification Search ..... 399/329, 399/324, 325, 328, 326
See application file for complete search history.

(56) References Cited

U.S. PATENT DOCUMENTS 3,794,417 A * 2/1974 Machmer ..... 399/322
5,119,143 A * 6/1992 Shimura ..... 399/329
5,675,893 A * 10/1997 Yamada et al. ..... 29/895.22
6,864,461 B2 * 3/2005 Okabayashi et al. ..... 399/329
6,983,118 B2 * 1/2006 Jaskowiak et al. ..... 399/328
2002/0015603 A1 * 2/2002 Kimura et al. ..... 399/325
2002/0136562 A1 * 9/2002 Hiroki et al. ..... 399/329
2006/0029444 A1 * 2/2006 Naito et al. ..... 399/329

FOREIGN PATENT DOCUMENTS

JP 7-281549 10/1995
JP 2003-223064 8/2003

OTHER PUBLICATIONS

Machine translation of Japanese Patent 2003-122149.*

* cited by examiner

*Primary Examiner*—David M. Gray
*Assistant Examiner*—Ruth N. LaBombard
(74) *Attorney, Agent, or Firm*—Morgan, Lewis & Bockius LLP

(57) ABSTRACT

A fixing device includes: a fixing belt member configured to be endless and rotatable; driving force transmission members that are disposed on respective ends of the fixing belt member, and transmits a rotational driving force to the fixing belt member; and a pressing member that is disposed to push an outer surface of the fixing belt member and forms a fixing nip part between the pressing member and the fixing belt member, wherein each of the driving force transmission members is fixed to the fixing belt member over an entire peripheral area of the corresponding end of the fixing belt member.

16 Claims, 11 Drawing Sheets

FIXING DEVICE IN IMAGE FORMING APPARATUS AND IMAGE FORMING APPARATUS WITH FIXING DEVICE

BACKGROUND OF THE INVENTION

1. Field of the Invention

The present invention relates to fixing devices which fix a toner image on a recording medium in image forming apparatuses using, for example, an electrophotographic method.

2. Description of the Related Art

In image forming apparatuses, such as copying machines and printers, which use an electrophotographic method, a photosensitive body (photosensitive drum) formed in the shape of, for example, a drum is uniformly charged and the photosensitive drum is scanned and exposed with light controlled on the basis of image information so that an electrostatic latent image is formed on the photosensitive drum. The electrostatic latent image is then turned into a visual image (toner image) with toner. Then, the toner image is directly transferred to a recording medium from the photosensitive drum, or the toner image is primarily transferred to an intermediate transfer medium and secondary transferred to a recording medium from the intermediate transfer medium. Thereafter, the toner image is fixed on the recording medium by a fixing device.

The fixing device used for such image forming apparatuses is composed of, for example, a fixing roller in which a heating source is disposed within a cylindrical core bar, and which is formed such that a heat-resistant elastic layer and a release layer on an outer peripheral surface of the elastic layer are laminated on the core bar; and a pressing roller which is disposed in pressure contact with the fixing roller parallel thereto and formed such that a heat-resistant elastic layer, and a release layer, made of a heat-resistant resin film or a heat-resistant rubber film, on an outer peripheral surface of the elastic layer are laminated on a core bar. Also, a recording medium having an unfixed toner image carried thereon is caused to pass between the fixing roller and the pressing roller so that heating and pressing is performed on the unfixed toner image, thereby fixing the toner image on the recording medium. Such a fixing device is called a two-roller fixing method and it has generally been widely used.

Meanwhile, in such a conventional fixing device using fixing rollers like the two-roller fixing method, the fixing rollers have their own large heat capacity. Therefore, there is a problem in that even when supply of power to the fixing devices is started simultaneously when a power source of the image forming apparatus is turned on, considerable time is required until the fixing rollers rise in temperature from normal temperature to a fixable temperature (warm-up). Because of the characteristics of the fixing rollers that quick start is difficult as such, when the image forming apparatus is in a standby state, it is also necessary to keep the temperature of the fixing rollers always constant to prepare for the start of the image forming operation. Therefore, there is also a problem in that electric power consumption of the fixing device is large.

In order to solve such problems, fixing devices using an endless fixing belt member have been developed instead of the configuration using the fixing roller. Since the fixing belt member has its base member made of a film-like heat-resistant resin or the like, it has advantages in that the heat capacity is small and the warm-up can be performed in a short time, as compared to a roller-shaped member such as the fixing rollers. Moreover, since the quick start is easy, the electric power consumption of an image forming apparatus in a standby state can also be reduced.

As an example of conventional techniques related to the fixing devices using the fixing belt member, the following technique is suggested (for example, see JP-A-2003-223064). According to this technique, the fixing device is configured such that a halogen heater is disposed in an inner space. The fixing device also is composed of a heating film (fixing belt member) rotatably supported by a support member, and a pressing roller member disposed in pressure contact with the heating film to form a fixing nip and to drive the heating film so that the heating film follows the pressing roller member. Infrared rays emitted from the halogen heater are converged on the fixing nip to heat the heating film in the nip part, thereby forming a toner image on a recording medium passing through the fixing nip on demand.

In such a fixing device using the fixing belt member, generally, the fixing belt member is adapted to follow the pressing roller member. However, in such a configuration in which the fixing belt member is caused to follow the pressing roller member, the rotational speed of the fixing belt member may change under the influence of a change in surface velocity of the fixing belt member caused by thermal expansion of the pressing roller member. Further, since the fixing belt member rotates with a frictional force from the pressing roller member, if the sliding resistance between the fixing belt member and a supporting member supporting the fixing belt member increases, slip is caused between the fixing belt member and the pressing roller member. Therefore, the rotational speed of the fixing belt member may be reduced. Accordingly, when a recording medium passes through the fixing nip part, there is a probability that disturbance may be caused in a fixed image on the recording medium or wrinkles are created in the recording medium.

As a method for suppressing such a change in the rotational speed of the fixing belt member, the following technique is also suggested (for example, see JP-A-7-281549). According to this technique, gears are respectively disposed at positions corresponding to an end of a fixing belt member and an end of a pressing roller member, and both the fixing belt member and the pressing roller member are rotated while the gears are caused to mesh with each other, or a recess (or protrusion) and a protrusion (or recess) are respectively disposed at positions corresponding to the end of the fixing belt member and the end of the pressing roller member, and both the fixing belt member and the pressing roller member are rotated while the recess (or protrusion) is caused to engage the protrusion (or recess), thereby suppressing a speed difference between the fixing belt member and the pressing roller member.

Meanwhile, since it is necessary to give a fixed image an appropriate degree of gloss in the fixing device composed of the fixing belt member and the pressing roller member, a predetermined pressure (a nip pressure) is required to be applied to the fixing nip part between the fixing belt member and the pressing roller member. As described above, if gears are allowed to engage each other between the fixing belt member and the pressing roller member between in order to suppress the reduction in rotational speed of the fixing belt member that follows the pressing roller member, a pushing force between the fixing belt member and the pressing roller member is limited by an engaging portion between the gears. Therefore, a problem may occur that it becomes difficult to apply a predetermined nip pressure to the fixing nip part. Accordingly, in order to stabilize the rotational speed of the fixing belt member, it is preferable to employ the configuration in which gear members are mounted on both ends of the fixing belt member, respectively, and the gear members are connected to a driving source to be driven thereby rather than the configuration which the fixing belt member indirectly receives a driving force from the pressing roller member to follow the pressing roller member. In this configuration, even when the pressing roller member thermally expands or the sliding resistance between the pressing roller member and the supporting member increases, the rotational speed of the fixing belt member can be stabilized. Further, since an engaging portion between gears exists between the fixing belt member and the pressing roller member, the pressing roller member can be brought into pressure contact with the fixing belt member with a desired pressure, and a predetermined nip pressure can also be set.

However, in a case in which an object to be rotatingly driven is made of a material having a high strength or rigidity like, for example, a metallic cylindrical body, a groove or a hole is formed in the cylindrical body and a protrusion corresponding the groove or the hole is formed in each gear member. Then, the cylindrical body and the gear member can be combined together by making the groove or the hole in the cylindrical body fit with the protrusion in the gear member. By this combining method, a rotational driving force can be easily transmitted to the cylindrical body without causing breakage, such as deformation or rupture, in the cylindrical body. In contrast, if an object to be rotatingly driven is a thin-walled fixing belt member having a low strength or rigidity, and the above-described general method of fitting the groove or the hole with the protrusion and of then partially combining the fixing belt member and the gear member together at a fitting portion between the groove or hole and the protrusion is used, stress may be concentrated on the fitting portion, which makes it impossible for the fixing belt member to endure the stress at the fitting portion only with its own strength. As a result, breakage such as rupture readily occurs in the fixing belt member. Therefore, there is a significant problem in that not only a driving force cannot be efficiently transmitted, but also breakage of the fixing belt member is finally caused, which makes the functions of the fixing device disabled.

SUMMARY OF THE INVENTION

The invention has been made to address the above-described technical problems.

According to an aspect of the invention, there is provided a fixing device including: a fixing belt member configured to be endless and rotatable; driving force transmission members that are disposed on respective ends of the fixing belt member, and transmit a rotational driving force to the fixing belt member; and a pressing member that is disposed to push an outer surface of the fixing belt member and forms a fixing nip part between the pressing member and the fixing belt member, wherein each of the driving force transmission members is fixed to the fixing belt member over an entire peripheral area of the corresponding end of the fixing belt member.

DETAILED DESCRIPTION OF THE INVENTION

An embodiment of the invention will be described with reference to the drawings.

FIRST EMBODIMENT

Figure 1:
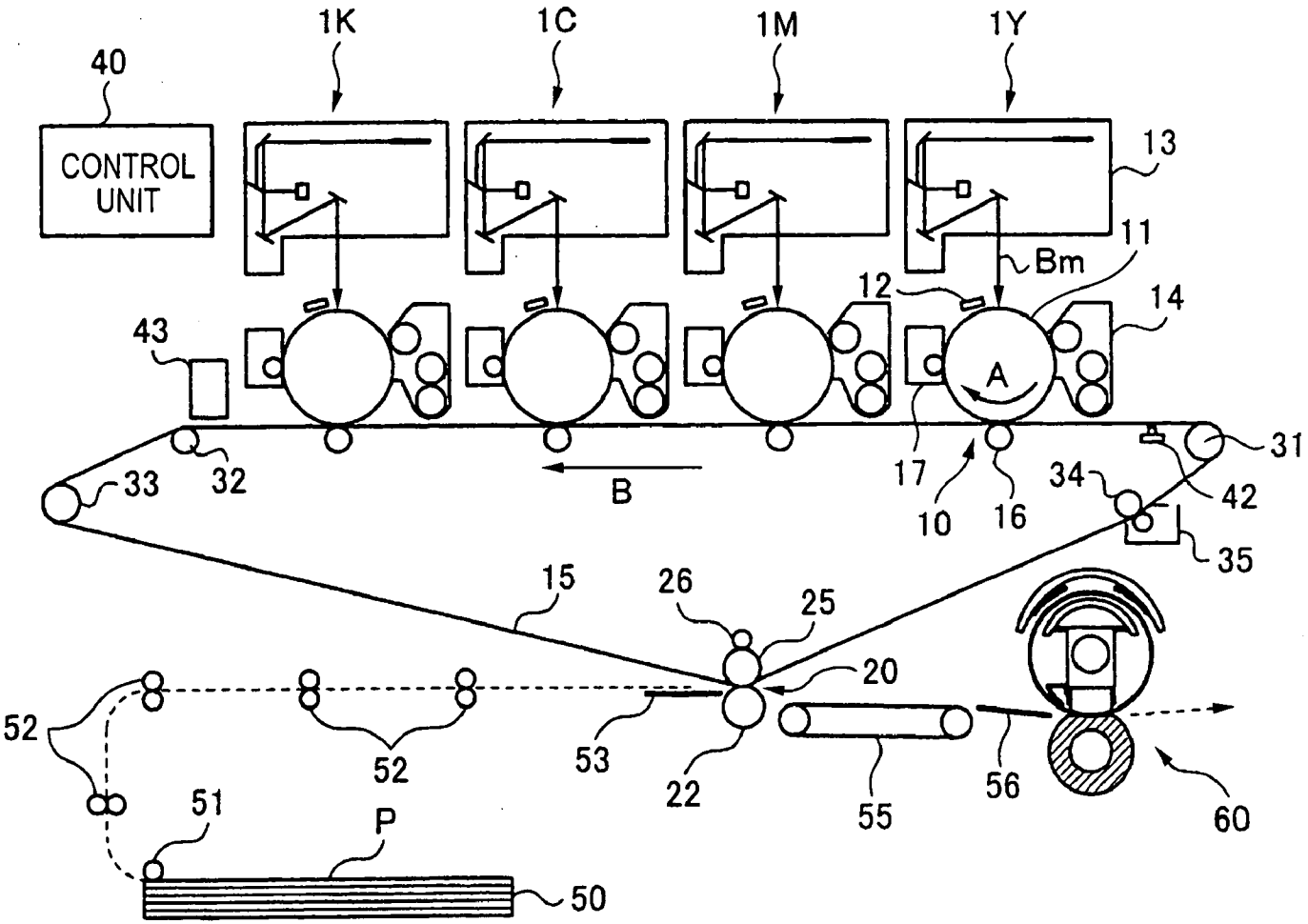
FIG. 1 is a schematic diagram showing a configuration of an image forming apparatus.

FIG. 1 is a schematic diagram showing the configuration of an image forming apparatus to which the present embodiment is applied. The image forming apparatus shown in FIG. 1 is an image forming apparatus of an intermediate transfer method, which is generally referred to as "tandem type". The image forming apparatus includes a plurality of image forming units 1Y, 1M, 1C and 1K in which color component toner images are respectively formed by an electrophotographic method, a primary transfer part 10 that sequentially transfers (primarily transfers) the color component toner images respectively formed by the image forming units 1Y, 1M, 1C and 1K to an intermediate transfer belt 15, a secondary transfer part 20 that collectively transfers (secondarily transfers) an overlapped toner image transferred onto the intermediate transfer belt 15 to paper P as a recording medium (recording paper), and a fixing device 60 that fixes the secondarily transferred image on the paper P. The image forming apparatus further includes a control unit 40 that controls the operation of each of the devices (units or parts).

In the present embodiment, each of the image forming units 1Y, 1M, 1C and 1K has electrophotographic devices sequentially arranged around a photosensitive drum 11 that rotate in a direction indicated by an arrow A. The electrophotographic devices include a charging device 12 that charges the photosensitive drum 11, a laser exposing device 13 (an exposure beam is indicated by the symbol Bm in the drawing), which writes an electrostatic latent image on the photosensitive drum 11, a developing device 14 that contains a color component toner and visualizes the electrostatic latent image on the photosensitive drum 11 with a toner, a primary transfer roller 16 that transfers the color component toner image formed on the photosensitive drum 11 to the intermediate transfer belt 15 in the primary transfer part 10, and a drum cleaner 17 that removes the residual toner on the photosensitive drum 11. These image forming units 1Y, 1M, 1C and 1K are sequentially arranged substantially linearly in the order of yellow (Y), magenta (M), cyan (C) and black (K) from the upstream side of the intermediate transfer belt 15.

The intermediate transfer belt 15 serving as an intermediate transfer body is composed of a film-like endless belt in which an adequate amount of antistatic agent, such as carbon black, is mixed in resin such as polyimide or polyamide. Also, the intermediate transfer belt has a volume resistivity of $10^6$ to $10^{14}$ Ωcm and a thickness of about 0.1 mm. The intermediate transfer belt 15 is driven (rotated) to circulate at a predetermined speed in a direction indicated an arrow B shown in FIG. 1 by means of various rollers. The various rollers includes a driving roller 31 which is driven by a motor (not shown) having an excellent constant-velocity property and rotates the intermediate transfer belt 15, a support roller 32 that extends substantially linearly in a direction where the photosensitive drums 11 are arrayed and supports the intermediate transfer belt 15, a tension roller 33 that applies a constant tension to the intermediate transfer belt 15 and functions as a correction roller for preventing meandering of the intermediate transfer belt 15, a backup roller 25 provided in the secondary transfer part 20, and a cleaning backup roller 34 provided in a cleaning part for scraping the residual toner on the intermediate transfer belt 15.

The primary transfer part 10 has a primary transfer roller 16 disposed to opposite to each photosensitive drum 11 with the intermediate transfer belt 15 therebetween. The primary transfer roller 16 includes a shaft, and a sponge layer as an elastic layer which is fixed around the shaft. The shaft is a cylindrical rod made of a metal such as iron or SUS. The sponge layer is formed of blended rubber of NBR, SBR and EPDM in which a conductive agent such as carbon black is blended. The sponge layer has a volume resistivity of $10^{7.5}$ to $10^{8.5}$ Ωcm, and it is a cylindrical roller having a sponge shape. Also, the primary transfer roller 16 is disposed in pressure contact with the photosensitive drums 11 with the intermediate transfer belt 15 therebetween. A voltage (a primary transfer bias) having a reverse polarity to a charged polarity (this is referred to as "negative polarity") of the toner is also applied to the primary transfer roller 16. Thus, the toner images on the photosensitive drums 11 are sequentially and electrostatically attracted on the intermediate transfer belt 15 so that an overlapped toner image is formed on the intermediate transfer belt 15.

The secondary transfer part 20 includes a secondary transfer roller 22 and a backup roller 25 both of which are disposed at a toner-image carrying surface of the intermediate transfer belt 15. The backup roller 25 has a surface formed of a tube made of blended rubber of EPDM and NBR in which carbon particles are dispersed, and an interior formed of EPDM rubber. Also, the backup roller 25 has a surface resistivity of $10^7$ to $10^{10}$ Ω/square and a hardness of, for example, 70° (Asker C hardness). The backup roller 25 is disposed at the rear side of the intermediate transfer belt 15, and forms a counter electrode to the secondary transfer roller 22. The back roller 25 is disposed to abut on a metallic feeding roller 26 to which secondary transfer bias is applied stably.

On the other hand, the secondary transfer roller 22 includes a shaft, and a sponge layer as an elastic layer is fixed around the shaft. The shaft is a cylindrical rod made of a metal such as iron or SUS. The sponge layer is formed of blended rubber of NBR, SBR and EPDM in which a conductive agent such as carbon black is blended. The sponge layer has a volume resistivity of $10^{7.5}$ to $10^{8.5}$ Ωcm and it is a cylindrical roller having a sponge shape. Also, the secondary transfer roller 22 is disposed in pressure contact with the backup roller 25 with the intermediate transfer belt 15 therebetween. Moreover, the secondary transfer roller 22 is grounded so that a secondary transfer bias is formed between the secondary transfer roller 22 and the backup roller 25. The secondary transfer roller 22 functions to secondarily transfer a toner image onto paper P conveyed to the secondary transfer part 20.

Further, an intermediate transfer belt cleaner 35 for removing the residual toner or paper powder on the intermediate transfer belt 15 and cleaning the surface of the intermediate transfer belt 15 after the secondary transfer is provided downstream of the secondary transfer part 20 of the intermediate transfer belt 15 so as to contact or separate from the intermediate transfer belt. Meanwhile, a reference sensor (a home position sensor) 42 for generating a reference signal which serves as a reference for obtaining an image forming timing in each of the image forming units 1Y, 1M, 1C and 1K, is disposed upstream of the yellow image forming unit 1Y. An image density sensor 43 for controlling the image quality is also disposed downstream of the black image forming unit 1K. The reference sensor 42 recognizes a predetermined mark formed on a rear side of the intermediate transfer belt 15 to generate a reference signal based on the recognized mark. Each of the image forming units 1Y, 1M, 1C and 1K is adapted to begin to form an image according to an instruction of the control unit 40 based on the recognition of the reference signal.

Moreover, in the image forming apparatus of the present embodiment, a paper conveying system includes a paper tray 50 for accommodating paper P, a pickup roller 51 for picking up and conveying the paper P stacked in the paper tray 50 with a predetermined timing, a conveying roller 52 for conveying the paper P paid out from the pickup roller 51, a conveying chute 53 for feeding the paper P conveyed by the conveying roller 52 to the secondary transfer part 20, a conveying belt 55 for conveying the paper P, which is secondarily transferred by the secondary transfer roller 22 and then conveyed, to the fixing device 60, and a fixing inlet guide 56 for guiding the paper P to the fixing device 60.

A basic image forming process of the image forming apparatus according to the present embodiment will now be described. In the image forming apparatus as shown in FIG. 1, image data output from image input terminals (IITs) (not shown), personal computer (PCs) (not shown) or the like undergoes predetermined image processing through an image processing system (IPS) (not shown), and then experience image forming processing through the image forming units 1Y, 1M, 1C and 1K. The IPS performs predetermined image processing, such as shading correction, positional deviation correction, brightness/color space conversion, gamma correction, frame erasing, or various kinds of image editing, such as color editing and motion editing on input reflectance data. The image data on which the image processing is performed are converted into four-color material (Y, M, C and K) grayscale data, and then output to the laser exposing device 13.

In the laser exposing device 13, an exposure beam Bm emitted from, for example, a semiconductor laser device is irradiated on the photosensitive drum 11 of each of the image forming units 1Y, 1M, 1C and 1K according to the received color material grayscale data. In the photosensitive drum 11 of each of the image forming units 1Y, 1M, 1C and 1K, the surface of the photosensitive drum 11 is charged by the charging device 12, and is then scanned and exposed by the laser exposing device 13, thereby forming an electrostatic latent image. The formed electrostatic latent image is developed as a toner image of each of the colors Y, M, C and K by each of the image forming units 1Y, 1M, 1C and 1K.

The toner image formed on the photosensitive drum 11 of each of the image forming units 1Y, 1M, 1C and 1K is transferred onto the intermediate transfer belt 15 in the primary transfer part 10 in which the photosensitive drum 11 abuts on the intermediate transfer belt 15. More specifically, in the primary transfer part 10, the primary transfer roller 16 applies a voltage (a primary transfer bias) having a reverse polarity to a charged polarity (a negative polarity) of the toner to the base of the intermediate transfer belt 15. Accordingly, the primary transfer is carried out in such as manner that the toner images are sequentially superimposed on the surface of the intermediate transfer belt 15.

After the toner images are sequentially primarily transferred onto the surface of the intermediate transfer belt 15, the intermediate transfer belt 15 moves to convey the toner images to the secondary transfer part 20. If the toner images are conveyed to the secondary transfer part 20, the pickup roller 51 rotates in the paper conveying system simultaneously when the toner images are conveyed to the secondary transfer part 20. The paper P of a predetermined size is then supplied from the paper tray 50. The paper P supplied from the pickup roller 51 is conveyed by the conveying roller 52, and then reaches the secondary transfer part 20 via the conveying chute 53. Before the paper P reaches the secondary transfer part 20, it is once stopped, and a registration roller (not shown) rotates at the timing when the intermediate transfer belt 15 having the toner images carried thereon moves. Thus, the position of the paper P is aligned with the position of the toner images.

In the secondary transfer part 20, the secondary transfer roller 22 is pushed against the backup roller 25 by the intermediate transfer belt 15. At this time, the paper P that is conveyed in a well-timed manner is inserted between the intermediate transfer belt 15 and the secondary transfer roller 22. In this case, if a voltage (a secondary transfer bias) having the same polarity as a charged polarity (a negative polarity) of the toner is applied from the feeding roller 26, a transfer electric field is formed between the secondary transfer roller 22 and the backup roller 25. Also, non-fixed toner images carried on the intermediate transfer belt 15 are collectively transferred on the paper P in the secondary transfer part 20 that is pushed by the secondary transfer roller 22 and the backup roller 25.

Thereafter, the paper P on which the toner images have been electrostatically transferred is conveyed by the secondary transfer roller 22 while it is peeled from the intermediate transfer belt 15. The paper is then conveyed to the conveying belt 55 provided downstream of the secondary transfer roller 22 in the paper-conveying direction. In the conveying belt 55, the paper P is conveyed up to the fixing device 60 at an optimal conveying speed in the fixing device 60. The non-fixed toner image on the paper P conveyed to the fixing device 60 undergoes fixing processing by means of the fixing device 60 with heat and pressure to be fixed on the paper P. Then, the paper P on which the fixed image has been formed is conveyed to a discharged paper placing part provided in the discharge part of the image forming apparatus.

Meanwhile, after the transfer to the paper P is finished, the residual toner on the intermediate transfer belt 15 is conveyed to a cleaning part with rotation of the intermediate transfer belt 15, and thus removed from the intermediate transfer belt 15 by the cleaning backup roller 34 and the intermediate transfer belt cleaner 35.

Next, the fixing device 60 used in the image forming apparatus of the present embodiment will be described.

Figure 2:
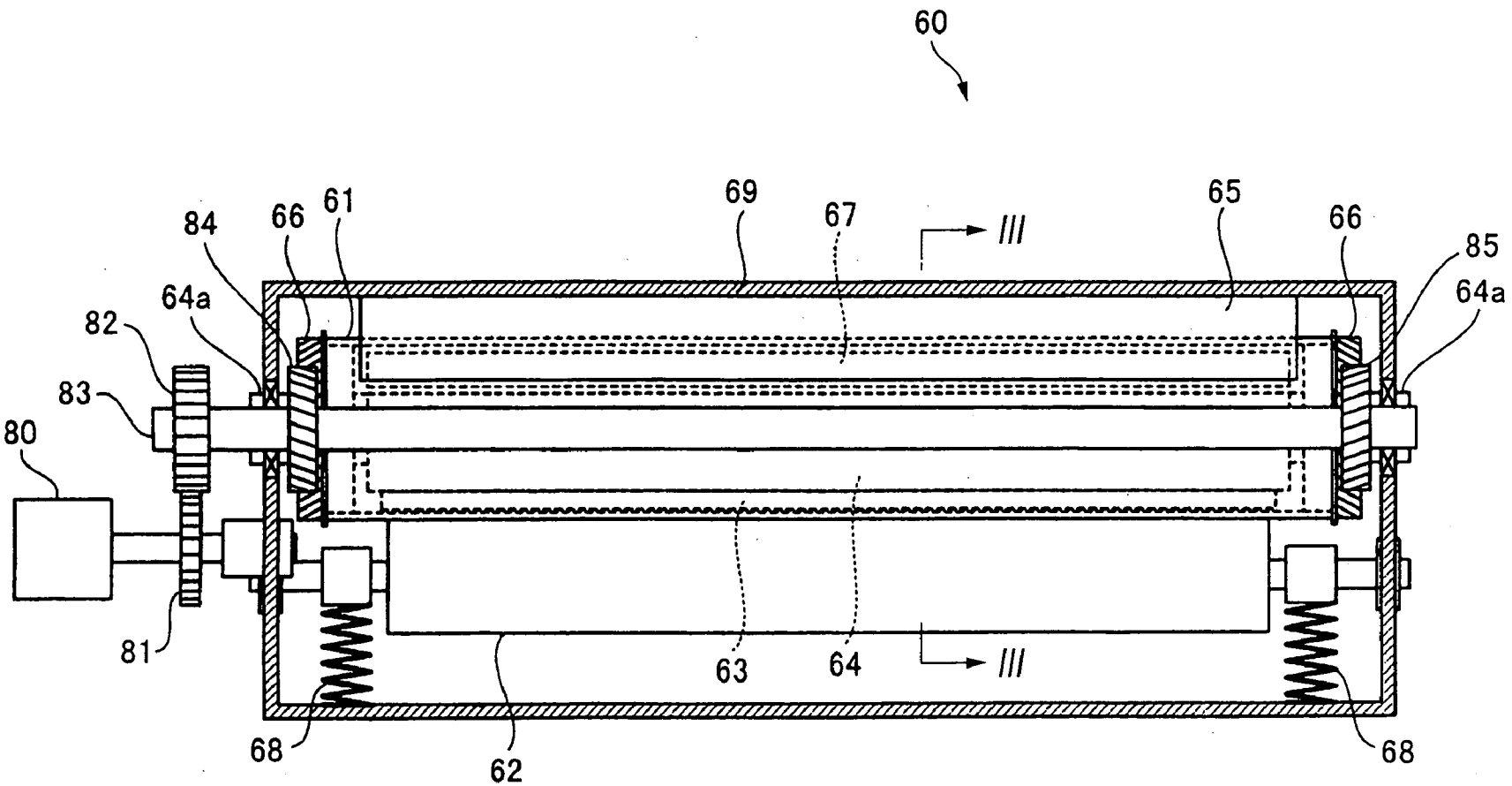
FIG. 2 is a schematic plan view showing a configuration of a fixing device according to a first embodiment.
Figure 3:
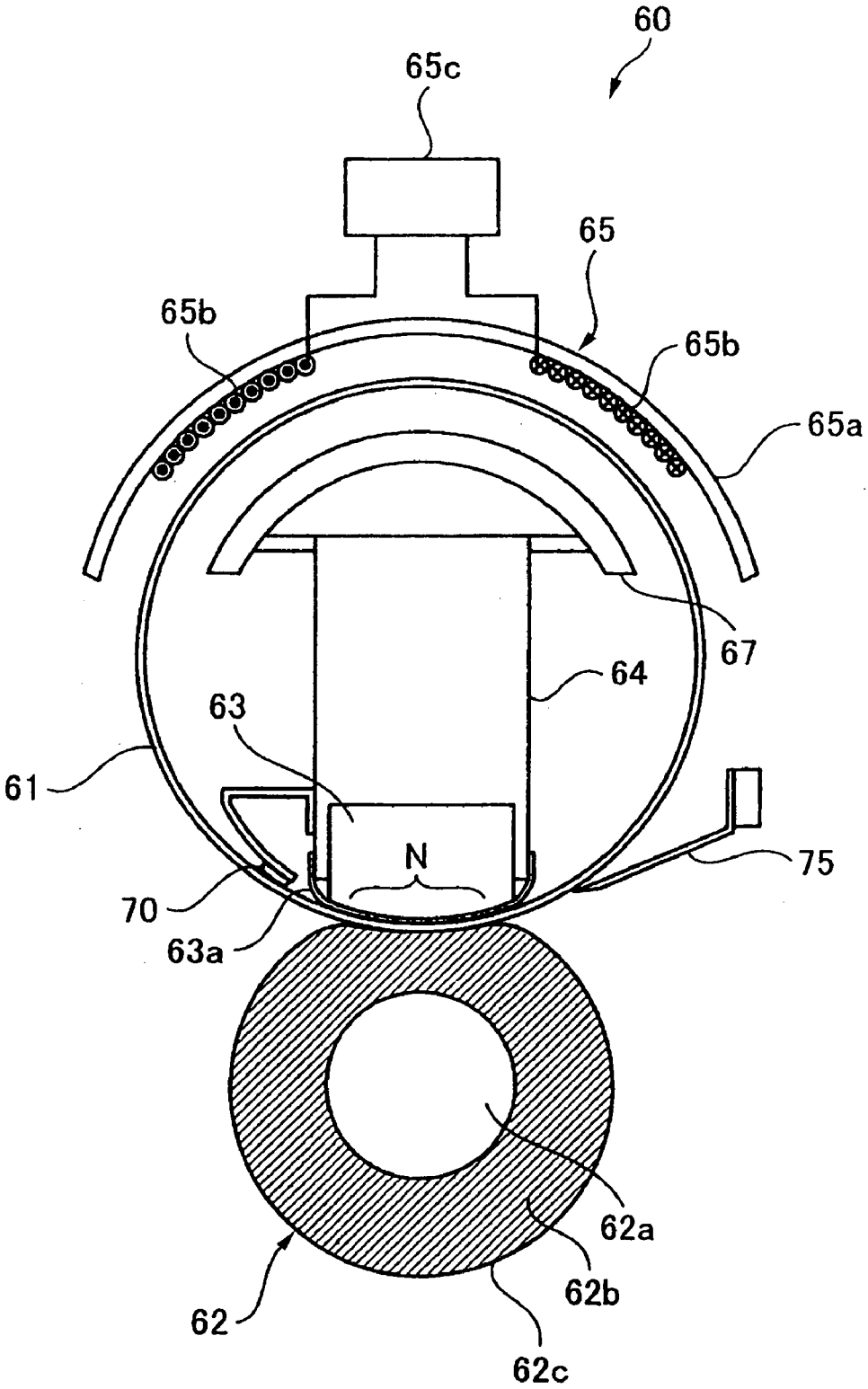
FIG. 3 is a cross-sectional view, taken along the line III-III, showing the configuration of the fixing device according to a first embodiment.

FIG. 2 is a schematic plan view showing a configuration of the fixing device 60 according to the present embodiment. FIG. 3 is a cross-sectional view taken along the line III-III in FIG. 2. As shown in FIGS. 2 and 3, the fixing device 60 of the present embodiment includes, as its principal parts, a fixing belt 61 as an example of a fixing belt member having an endless peripheral surface, a pressing roller 62 as an example of the pressing member (pressing roller member) which is disposed in pressure contact with an outer peripheral surface of the fixing belt 61 and rotates following the rotation of the fixing belt 61, a pushing pad 63 which is disposed in pressure contact with the pressing roller 62 inside the fixing belt 61 with the fixing belt 61 therebetween, a pad supporting member 64 as an example of a supporting member which supports the pushing pad 63, etc., an electromagnetically induced heating member 65 which is formed in imitation of the profile of the outer peripheral surface of the fixing belt 61 and disposed with a predetermined gap from the fixing belt 61 to heat the fixing belt 61 in its longitudinal direction in an electromagnetically induced heating manner, an end cap member 66 as an example of a driving force transmission member which is disposed at each of both ends of the fixing belt 61 to rotatingly drive the fixing belt 61 in its peripheral direction while maintaining the sectional shape of the both ends of the fixing belt 61 in a circular shape, a ferrite member 67 which is disposed along an inner peripheral surface of the fixing belt 61 inside the fixing belt 61 to enhance the efficiency that the fixing belt 61 is heated by the electromagnetically induced heating member 65, and a temperature detecting sensor 70 which detects the temperature of the fixing belt 61.

Figure 4:
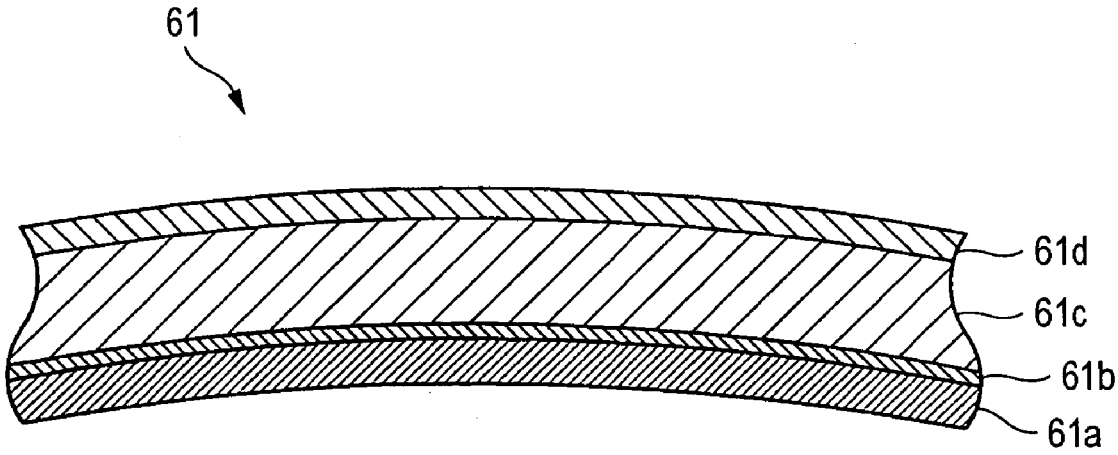
FIG. 4 is a view illustrating a layer configuration of a fixing belt.

As shown in FIG. 4, the fixing belt 61 is configured such that a base layer 61*a* made of a high heat-resistant sheet-like member, a conductive layer 61*b*, an elastic layer 61*c*, and a surface release layer 61*d* to be an outer peripheral surface are laminated in this order from the inner peripheral side. Further, a primer layer, etc. for bonding may be provided between the respective layers.

As the base layer 61*a*, flexible materials having an excellent mechanical strength and heat resistance, such as fluorocarbon resin, polyimide resin, polyamide resin, polyamide-imide resin, PEEK resin, PES resin, PPS resin, PFA resin, PTFE resin, and FEP resin may be used. The thickness of the base layer is 10 to 150 μm, and preferably 30 to 100 μm. This is because that if the thickness of the base layer is smaller than 10 μm, strength as the fixing belt 61 cannot be obtained, whereas if the thickness of the base layer is larger than 150 μm, the flexibility is deteriorated, and the heat capacity is so large that the temperature rising requires a longer time. In the present embodiment, a sheet-like member having a thickness of 80 μm and made of a polyimide resin is used as the base layer.

The conductive layer 61*b* is a layer which inductively generates heat by a magnetic field induced by the electromagnetically induced heating member 65. A layer obtained by forming a layer of a metal such as iron, cobalt, nickel, copper, aluminum, or chrome with a thickness of about 1 to 80 μm is used as the conductive layer. Further, the material and thickness of the conductive layer 61*b* is appropriately selected so that a resistivity value that sufficient heat generation is obtained by an eddy current by electromagnetic induction can be implemented. In the present embodiment, copper having a thickness of about 10 mm is used as the conductive layer.

The elastic layer 61*c* has a thickness of 10 to 500 μm, and preferably a thickness of 50 to 300 μm. Materials having an excellent heat resistance and thermal conductance, such as silicon rubber, fluorocarbon rubber, fluorosilicon rubber, and the like, are used as the elastic layer. In the present embodiment, silicon rubber having a rubber hardness of 15° (JIS-A: JIS-K, A-type testing machine) and a thickness of 200 μm is used as the elastic layer.

Meanwhile, when a color image is printed, in particular, when photographs are printed, a beta image is often formed on a paper P over a large area. Therefore, if the surface (surface release layer 61*d*) of the fixing belt 61 cannot follow irregularities of the paper P or the toner image thereon, uneven heating may be caused in the toner image, and thus uneven gloss may be caused in a portion having a larger amount of heat transfer and a portion having a smaller amount of heat transfer in a fixed image. In other words, the glossiness becomes high in the portion having a larger amount of heat transfer, and the glossiness becomes low in the portion having a smaller amount of heat transfer. This phenomenon is liable to occur if the thickness of the elastic layer 61*c* is smaller than 10 μm. Thus, it is preferable that the thickness of the elastic layer 61*c* be set to 10 μm or more, and more preferably, 50 μm or more. On the other hand, if the thickness of the elastic layer 61*c* is larger than 500 mm, thermal resistance of the elastic layer 61*c* becomes larger and quick start performance of the fixing device 60 is degraded. Thus, it is preferable that the thickness of the elastic layer 61*c* be set to 500 μm or less, and more preferably, to 300 μm or less.

Further, if the rubber hardness of the elastic layer 61*c* is too high, the surface of the fixing belt cannot follow irregularities of the paper P or the toner image thereon, and consequently uneven gloss is likely to be caused in a fixed image. Thus, the rubber hardness of the elastic layer 61*c* is 50° or less (JIS-A: JIS-K, A-type testing machine), and more preferably, 35° or less.

Moreover, the thermal conductivity λ of the elastic layer 61*c* is preferably $\lambda=6\times10^{-4}$ to $2\times10^{-3}$ [cal/cm·sec·deg]. If the thermal conductivity λ is smaller than $6\times10^{-4}$ [cal/cm·sec·deg], the heat resistance is great, temperature rise in a surface layer of the fixing belt 61 becomes slow. On this other hand, if the thermal conductivity l is larger than $\lambda=2\times10^{-3}$ [cal/cm·sec·deg], the hardness becomes high, or the compression set increases. Therefore, the thermal conductivity l is set to, preferably, $\lambda=6\times10^{-4}$ to $2\times10^{-3}$ [cal/cm·sec·deg], and more preferably $\lambda=8\times10^{-4}$ to $1.5\times10^{-3}$ [cal/cm·sec·deg].

Further, since the surface release layer 61*d* is a layer which directly contacts an unfixed toner image transferred onto a paper P, it is necessary to use a material having an excellent releasability and heat resistance. Accordingly, as the material for forming the surface release layer 61*d*, for example, tetrafluoroethyleneperfluoroalkylvinylether polymers (PFA), polytetrafluoroethylene (PTFE), fluorocarbon resin, silicon resin, fluorosilicon rubber, fluorocarbon rubber, silicon rubber, and the like may be used.

Further, the thickness of the surface release layer 61*d* is preferably 5 to 50 μm. This is because a problem may occur that if the thickness of the surface release layer 61*d* is smaller than 5 mm, uneven coating is caused at the time of film coating, and thus an area with bad releasability is formed or the durability is insufficient. This is also because that a problem may occur that if the thickness of the surface release layer 61*d* exceeds 50 μm, the thermal conductance deteriorates, and in particular, in the surface release layer 61*d* formed of a resin-based material, the hardness becomes excessively high, thereby deteriorating the functions of the elastic layer 61*c*. Incidentally, in the present embodiment, PFA having a thickness of 30 μm is used as the surface release layer.

It is noted herein that an oil applicator that applies oil (lubricant) for preventing toner offset to the surface release layer 61*d* may be disposed to abut against the fixing belt 61 in order to improve the toner releasability in the surface release layer 61*d*. In particular, it is advantageous to use the oil applicator in a case where toner that does not contain a softening material is used.

Next, as shown in FIG. 3, the pressing roller 62 is composed of a metallic cylindrical member 62*a* serving as a core, an elastic layer 62*b* formed on the surface of the cylindrical member 62*a* and made of a heat-resistant material, such as silicon rubber, foamed silicon rubber, fluorocarbon rubber, or fluorocarbon resin, and a surface release layer 62*c* on the outermost surface. As shown in FIG. 2, the pressing roller 62 is disposed parallel to a rotation axis of the fixing belt 61, and has its both ends urged toward the fixing belt 61 by a spring member 68 and supported thereby. In the present embodiment, the pressing roller 62 is urged against the pushing pad 63 with a total load of 294 N (30 kgf) with the fixing belt 61 therebetween. This configuration allows the pressing roller 62 to rotate following the rotation of the fixing belt 61.

The pushing pad 63 is formed of an elastic material such as silicon rubber or fluorocarbon resin, or a heat-resistant material such as polyimide resin, polyphenylene sulfide (PPS) or polyether sulfone (PES) or liquid crystal polymers (LCP). Also, the pushing pad 63 is disposed over a slightly wider area in the width direction of the fixing belt 61 than an area (paper pass area) through which a paper P passes. Also, the pushing pad 63 is adapted to push the pressing roller 62 over almost the entire length of the pushing pad 63 in its longitudinal direction.

The sectional shape of a surface of the pushing pad 63 which contacts the fixing belt 61 can be set to any value depending on paper peeling performance or fixing performance required for the fixing device 60. In the fixing device 60 of the present embodiment, the sectional shape of the pushing pad is formed in the shape of a curved surface that has almost the same curvature as the fixing belt 61 whose shape is maintained in a circular shape in the end cap members 66. However, in order to further improve the peeling performance or the fixing performance, the pushing pad may be formed so that its curvature of the contact surface varies in the conveying direction of a paper P.

Further, in order to improve sliding performance between the pushing pad 63 and the fixing belt 61 in a fixing nip part N, a sliding sheet 63*a*, such as a glass fiber sheet, in which polyimide film or fluorocarbon resin having an excellent sliding performance and high wear resistance is impregnated, is disposed between the pushing pad 63 and the fixing belt 61. Moreover, lubricant is applied on an inner peripheral surface of fixing belt 61. As the lubricant, amino-modified silicon oil, dimethyl silicon oil, and the like are used. The use of such oils enables the frictional resistance between the fixing belt 61 and the pushing pad 63 to be reduced and the fixing belt 61 to be rotated smoothly.

The pad supporting member 64 is a rod-shaped member which has an axis in the width direction of the fixing belt 61, and is configured such that a shank 64*a* protrudes from each of its both ends. Also, the shank 64*a* is fixed to a frame 69 of the fixing device 60 whereby the pad supporting member 64 is supported by the frame 69. The end cap member 66 to be described in the following sections is disposed via a bearing about the axis of the shank 64*a* at each end of the fixing belt 61. The shank 64*a* of the pad supporting member 64 rotatably supports the fixing belt 61 on which the end cap member 66 is mounted.

Moreover, the pushing pad 63 is attached to a portion of the pad supporting member 64 which faces the pressing roller 62. A pushing force which acts on the pushing pad 63 via the fixing belt 61 from the pressing roller 62 is borne by the pad supporting member 64. Therefore, as the material for forming the pad supporting member 64, a material is used which has a rigidity such that the amount of deflection when the pad supporting member receives a pushing force from the pressing roller 62 is below a predetermined level, and preferably, below 1 mm. Therefore, in consideration of the needs that the pad supporting member should be hardly heated even by the influence of magnetic fluxes generated by the electromagnetically induced heating member 65, for example, heat-resistant resin, such as PPS with glass fibers, phenol, polyimide, and liquid crystal polymers, heat-resistant glass, metal such as aluminum which has a small resistivity and is less susceptible to influence of the induced heating. In the present embodiment, the pad supporting member 64 is made of aluminum such that the sectional shape of its main body is formed in a rectangular shape having a long axis in a pushing direction from the pressing roller 62, and the sectional shape of the shank 64*a* is formed in a substantially circular shape.

Incidentally, supposing that the pad supporting member 64 is curved by a pushing force between itself and pressing roller 62, in order to correct any deflection due to the curving, it is also effective if a contact surface of the pushing pad 63 with the fixing belt 61 is set to a convex shape in which is bulged nearest toward the pressing roller 62 at a center portion of the pushing pad in its longitudinal direction. Specifically, with the pad supporting member 64 being deflected, the shape of the surface of the pushing pad 63 on the side of the fixing belt 61 is corrected so that a contact surface of the pushing pad 63 with an inner peripheral surface of the fixing belt 61 and a contact surface of the pressing roller 62 with an outer peripheral surface of the fixing belt 61 form a substantially straight line. Since this allows the rotation axis of the fixing belt 61 to be a substantially straight line from both ends of the fixing belt to the paper pass area even if the pad supporting member 64 is curved, it is possible to achieve smooth rotation with no vibration which may be caused by eccentricity of the fixing belt 61, and it is also possible to achieve uniform pressing in the width direction between the pressing roller 62 and the pushing pad 63.

Moreover, the pad supporting member 64 is made of a material having a high permeability (for example, ferrite or permalloy). Also, the ferrite member 67 for enhancing the heating efficiency of the electromagnetically induced heating member 65 and the temperature detecting sensor 70 for detecting the temperature of the fixing belt 61 are fixed to the pad supporting member 64. Further, one shank 64*a* of the pad supporting member 64 is provided with a groove that allows passage of a lead wire from the temperature detecting sensor 70.

Figure 5A:
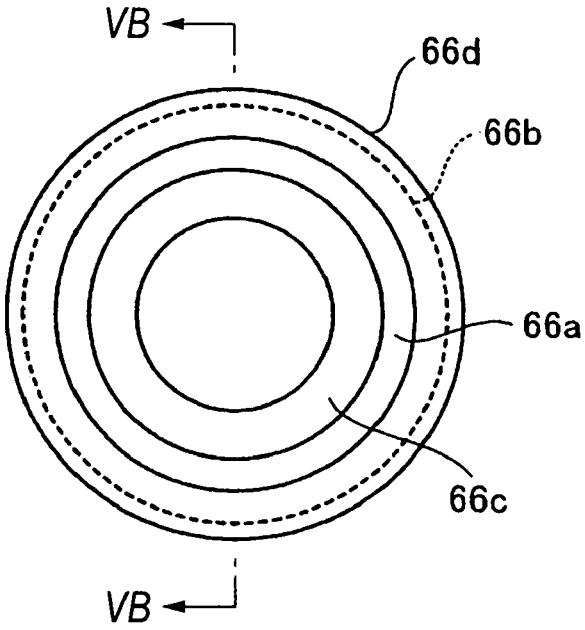
FIGS. 5A and 5B are views showing the structure of an end cap member.
Figure 5B:
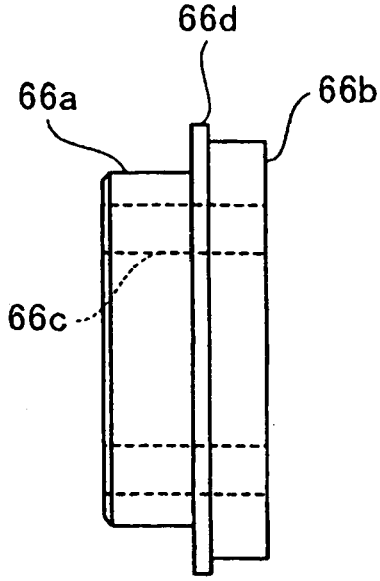

Next, the end cap member 66 will be described. FIG. 5A is a plan view of the end cap member 66, FIG. 5B is a cross-sectional view taken along a line VB-VB shown in FIG. 5A. As shown in FIGS. 5A and 5B, the end cap member 66 is a member obtained by combining cylindrical bodies having internal diameters approximately equal to each other and external diameters different from each other with the same shaft. The end cap member includes a stationary part 66*a* to be inserted into both side edges (both ends) of the fixing belt 61, a collar part 66*d* formed so as to have a larger external diameter than the stationary part 66*a* and protrude more in the radially outward direction than the fixing belt 61 when the fixing belt 61 is mounted, a bearing part 66*c*, such as a bearing, which is rotatably coupled to the shank 64*a* of the pad supporting member 64. Also, the end cap members 66 are mounted on both ends of the fixing belt 61, respectively, and is supported by the shank 64*a* of the pad supporting member 64 so that the inside surface (surface orthogonal to the rotation axis of the fixing belt 61) of the stationary part 66*a* faces both end faces of a main body of the pad supporting member 64 in proximity thereto.

As the material for forming the end cap member 66, so-called engineering plastic having excellent mechanical characteristics and high heat resistance is suitable. For example, phenol resin, polyimide resin, polyamide resin, polyamide-imide resin, PEEK resin, PES resin, PPS resin, LCP resin, resins containing glass or carbon in those resins, and the like can be selected.

When such end cap members 66 is inserted into each end of the fixing belt 61 to be mounted thereon, the fixing belt 61 will have mechanical characteristics similar to a thin-walled roller having a certain degree of rigidity from a flexible state up to the moment.

In this way, when the end cap member 66 is mounted on each end of the fixing belt 61, even a portion of the fixing belt 61 several millimeters away from the end face of the stationary part 66*a* of the end cap member 66 is concaved by application of an external force from the outer peripheral surface of the fixing belt 61. However, even if a twisting torque is applied to the whole fixing belt 61, the fixing belt 61 will be hardly twisted and will not be readily buckled. Generally, torque acting on a fixing device which uses a belt member like the fixing belt 61 is about 0.1 to 0.5 N·m. A structure in which the end cap member 66 is mounted on each end of the fixing belt 61 can keep the fixing belt 61 from being buckled due to this level of torque.

Further, even if the fixing belt 61 receives a compressive in its axial direction from both ends thereof, the fixing belt 61 will not be readily buckled by such an axial compressive force. Such compressive force acting in the axial direction is generated when bias movement of the fixing belt 61 to any one side is restricted. However, the magnitude of such a compressive force is typically 1 to 5 N. The structure in which the end cap member 66 is mounted on each end of the fixing belt 61 can also keep the fixing belt 61 from being buckled due to even this level of compressive force.

Also, in the fixing device 60 which uses the fixing belt 61 having the end cap member 66 mounted at each end thereof, as shown in FIG. 2, a rotational driving force is transmitted to the shaft 83 via transmission gears 81 and 82 from a driving motor 80 as a driving unit, and then transmitted to gear parts 66*b* at both ends of the end cap member 66 from transmission gears 84 and 85 coupled to the shaft 83. This allows a rotational driving force to be transmitted to the fixing belt 61 from the end cap member 66 to drive to rotate the end cap member 66 and the fixing belt 61 integrally. At this time, since the rotation axis of the fixing belt 61 coincides with the central axis of the shank 64*a* of the pad supporting member 64, the fixing belt 61 performs a smooth rotational operation about the central axis of the shank 64*a*. Also, since the fixing belt 61 has mechanical characteristics similar to a thin-walled roller having a certain degree of rigidity by virtue of mounting of the end cap member 66 to each end of the fixing belt 61, the fixing belt 61 will not be buckled.

Further, since the disposition of the end cap member 66 allows the sectional shape of both ends of the fixing belt 61 to be maintained in a circular shape, the portion of the fixing belt 61 in its width direction corresponding to the paper pass area rotates while its substantially circular shape is kept constant by virtue of the rigidity of the fixing belt 61 itself having the end cap member 66 mounted at each end thereof even though a member supporting the fixing belt 61 other than the pushing pad 63 is not provided in the fixing belt 61 (see FIG. 3).

Moreover, in the fixing device 60 of the present embodiment, the position of the outer peripheral surface (the surface which abuts on the inner peripheral surface of the fixing belt 61) of the pushing pad 63 is set to coincide approximately with the position of the outer peripheral surface of the stationary part 66*a* of the end cap member 66 with respect to the radial direction of the fixing belt 61. In other words, the outer peripheral surface of the pushing pad 63 and the outer peripheral surface of the stationary part 66*a* are set to be located in almost the same plane. Since this allows the position of the rotation axis of the fixing belt 61 to be set to coincide approximately with both ends of the fixing belt 61 and the paper pass area, stable rotation of the fixing belt 61 can be realized.

Next, the electromagnetically induced heating member 65 will be described. As shown in FIG. 3, the electromagnetically induced heating member 65 includes, as its main parts, a pedestal 65*a* which has a curved surface fashioned after the shape of the outer peripheral surface of the fixing belt 61 in the width direction of the fixing belt 61 on the side of the fixing belt 61, an exciting coil 65*b* supported by the pedestal 65*a*, and an exciting circuit 65*c* which supplies the exciting coil 65*b* with a high-frequency current to.

The pedestal 65*a* is made of an insulating and heat-resistant material. For example, phenol resin, polyimide resin, polyamide resin, polyamide-imide resin, liquid crystal polymer resin, and the like can be used as the material. As the exciting coil 65*b*, the following material is used. This material is formed by binding a plurality of copper wires, which are insulated from each other by a heat-resistant insulating material (for example, polyimide resin, polyamide-imide resin, or the like) and have a diameter $\phi$ of 0.5 mm, and by winding the resulting litz wire a plurality of times (for example, eleven turns) in the shape of a closed loop, such as a slotted shape, an elliptical shape or a rectangular shape. Also, fixation of the exciting coil 65*b* with adhesive allows the exciting coil 65*b* to be fixed to the pedestal 65*a* while the shape of the exciting coil is maintained.

Further, since the exciting coil 65*b* or the ferrite member 67, and the conductive layer 61*b* of the fixing belt 61 may be disposed as close to each other as possible in order to enhance absorption of the magnetic fluxes, the distance therebetween is set to within 5 mm, for example, about 2.5 mm. In this case, there is no need that the distance between the exciting coil 65*b* and the conductive layer 61*b* of the fixing belt 61 is constant.

In the electromagnetically induced heating member 65, if a high-frequency current is supplied to the exciting coil 65*b* from the exciting circuit 65*c*, magnetic fluxes are repeatedly generated or disappear about the exciting coil 65*b*. Here, the frequency of the high-frequency current is set to, for example, 10 to 500 kHz, but is set to 30 kHz in the present embodiment. If the magnetic fluxes from the exciting coil 65*b* traverse the conductive layer 61*b* of the fixing belt 61, a magnetic field that hinders a change in the above magnetic field is generated in the conductive layer 61*b* of the fixing belt 61, thereby generating an eddy current in the conductive layer 61*b*. Also, in the conductive layer 61*b*, Joule's heat ($W=I^2R$) is generated in proportional to a surface resistance (R) of the conductive layer 61*b* by an eddy current (I) to heat the fixing belt 61.

Incidentally, in that case, the temperature of the fixing belt 61 is maintained at a predetermined temperature by controlling the electric energy to be supplied to the exciting coil 65*b*, the supply time of the high-frequency current, and the like by a control unit 40 (see FIG. 1) of the image forming apparatus based on measurement values by the temperature detecting sensor 70.

Subsequently, the operation of the fixing device 60 of the present embodiment will be described.

In the image forming apparatus of the present embodiment, almost at the same time when the operation of forming a toner image is started, electric power is supplied to the driving motor 80 for driving the fixing belt 61 and the electromagnetically induced heating member 65 in the fixing device 60, thereby starting the fixing device 60. Then, the fixing belt 61 is rotated. With the rotation of the fixing belt, the pressing roller 62 rotates. Further, as the fixing belt 61 passes through a heated area which facing the electromagnetically induced heating member 65, an eddy current is induced in the conductive layer 61*b* of the fixing belt 61 to cause the fixing belt 61 to generate heat. With the fixing belt 61 being uniformly heated to a predetermined temperature, a paper P which carries an unfixed toner image is fed into the fixing nip part N where the fixing belt 61 is brought into pressure contact with the pressing roller 62. In the fixing nip part N in the paper pass area, a paper P and a toner image carried on the paper P is heated and pressed so that the toner image is fixed on the paper P. Thereafter, the paper P is peeled off from the fixing belt 61 and then conveyed to a discharged sheet placing part provided in a discharge part of the image forming apparatus. In this case, as an auxiliary means for completely separating the paper P after the fixing from the fixing belt 61, a peeling-assisting member 75 may be disposed downstream of the fixing nip part N of the fixing belt 61.

In the fixing device 60 of the present embodiment, the fixing belt 61 is uniformly heated to a predetermined temperature required for fixing a toner image. Thus, a good toner image for which occurrence of uneven gloss or offset is suppressed is formed. Further, since the fixing belt 61 can be heated at a high speed, it is possible to realize an image forming apparatus having an excellent on-demand property and greatly reduce the power consumption during standby of the apparatus. Moreover, the fixing belt 61 is at each end thereof mounted with the stationary part 66*a* of the end cap member 66 and is brought into contact with the end cap member 66, but it rotates without contacting any members other than the pushing pad 63 in the paper pass area. Therefore, since efflux of heat caused by contact between the fixing belt 61 and other members can be suppressed to an extremely small amount, the heat generated in the fixing belt 61 can be efficiently used for fixing processing.

Further, in the fixing device 60 of the present embodiment, the fixing belt 61 is configured such that a rotational driving force from the driving motor 80 provided in a main body of the image forming apparatus is transmitted via the transmission gear 81 and the transmission gear 82, and the shaft 83, and further transmitted to the gear part 66*a* of the end cap member 66 disposed at each end of the fixing belt 61 from the transmission gear 84 and the transmission gear 85 so that the rotational driving force is applied from each end of the fixing belt 61 to rotatingly drive the fixing belt 61 directly (see FIG. 2). Unlike an indirect fixing belt driving method such that the fixing belt 61 is driven by a frictional force from the pressing roller 62, a problem is solved that slip is caused between the fixing belt 61 and the pressing roller 62 to reduce the rotational speed of the fixing belt 61 in a case where the rotational speed of the fixing belt 61 changes or the sliding resistance between the fixing belt 61 and the pushing pad 63 increases, under the influence of a change in the surface velocity of the fixing belt caused by thermal expansion of the pressing roller 62. This enables the rotational speed of the fixing belt 61 to be stabilized. Therefore, it is possible to suppress that a fixed image on a paper P is disturbance or the paper P is wrinkled when the paper P passes through the fixing nip part N. According to the results of a running test carried out by the present inventor, in a configuration (conventional example) in which the fixing belt 61 follows the pressing roller 62, when a thin paper P having a basic weight of 56 g/m$^2$ is used, paper wrinkle and image disturbance were caused in 10% sheets per 10,000 sheets of paper P passed, and thereafter in about 50% sheets per 50,000 sheets of paper passed, and in about 100% sheets per 100,000 sheets of paper passed, which shows an increase in the rate of occurrence of the paper wrinkle or image disturbance. In contrast, in the fixing device 60 of the present embodiment, it is confirmed that paper wrinkle or image disturbance is not caused until pass of 100,000 sheets of paper.

Figure 6:
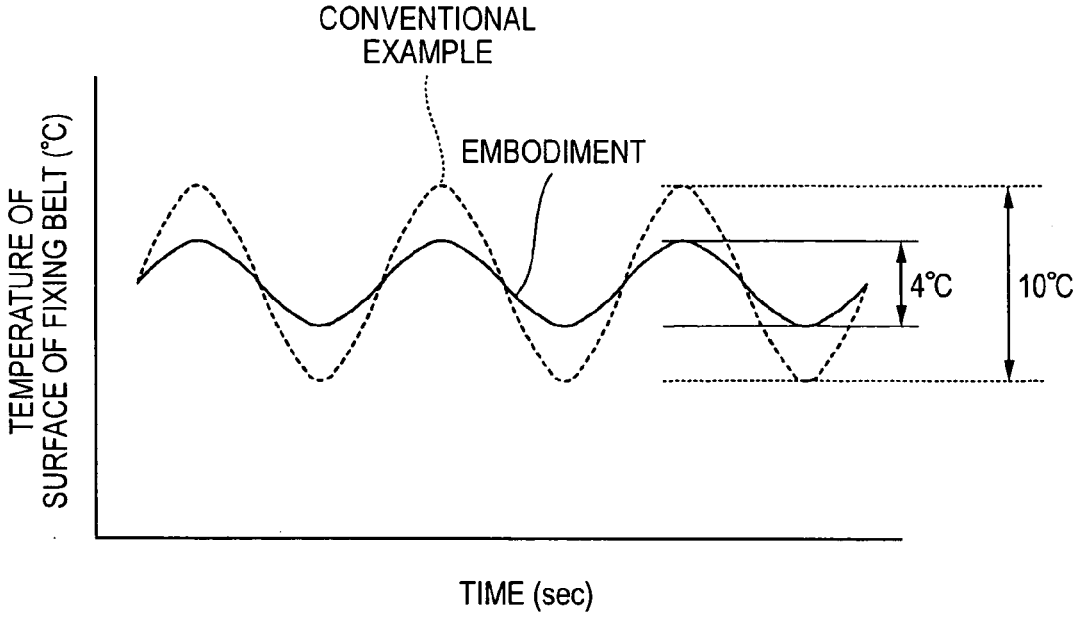
FIG. 6 is a view when unevenness of the surface temperature of the fixing belt in its peripheral direction is compared with that of a conventional example.

Moreover, the rotational speed and rotation orbit of the fixing belt 61 can be stabilized. Therefore, the fixing belt 61 can be uniformly heated along its peripheral direction. FIG. 6 is a graph showing results obtained by measuring a change in the surface temperature of the fixing belt 61 in its peripheral direction is measured while the fixing belt 61 rotates. As shown in FIG. 6, the temperature deviation of the fixing belt 61 is about 4° C. in the fixing device 60 of the present embodiment, whereas the temperature deviation concerned was about 10° C. in the configuration (conventional example) in which the fixing belt 61 follows the pressing roller 62. It can be appreciated from the foregoing that the invention is remarkably improved as compared with the conventional example.

Meanwhile, the fixing device 60 of the present embodiment is configured such that a rotational driving force is applied from the end cap member 66 mounted on each end of the fixing belt 61 to rotatingly drive the fixing belt 61 directly. In this connection, since the fixing belt 61 is a thin-walled belt member which does not have a high strength and intensity, when fixation is performed between the fixing belt 61 and the end cap member 66, it is necessary to prevent a stress from being concentrated in a specific portion of a joined portion between the fixing belt 61 and the stationary part 66*a* of the end cap member 66 and perform the fixation so as not to damage the fixing belt 61. Thus, in the fixing device 60 of the present embodiment, the fixing belt 61 and the end cap member 66 is fixed over an entire peripheral surface of a joined surface between the outer peripheral surface of the stationary part 66*a* of the end cap member 66 and the inner peripheral surface of the fixing belt 61 so that the outer peripheral surface of the stationary part 66*a* and the inner peripheral surface of the fixing belt 61 are combined with each other over its entire peripheral area.

Specifically, the stationary part 66*a* is fitted into fixing belt 61, and adhesive is then coated on the joined surface between the outer peripheral surface of the stationary part 66*a* and the inner peripheral surface of the fixing belt 61 over the entire peripheral surface of the joined surface to fix them together. In this case, it is possible to employ a configuration in which the stationary part 66*a* is fitted on the fixing belt 61, the inner peripheral surface of the stationary part 66*a* and the outer peripheral surface of the fixing belt 61 are joined together, and adhesive is coated on an entire peripheral surface of a joined portion between the inner peripheral surface of the stationary part 66*a* and the outer peripheral surface of the fixing belt 61 to fix them together. As another method, the stationary part 66*a* is inserted into the fixing belt 61, and then the fixing belt 61 and the end cap member 66 are strongly fitted with each other and fixed together at an entire peripheral surface of a joined surface between the outer peripheral surface of the stationary part 66*a* and the inner peripheral surface of the fixing belt 61. Moreover, the stationary part 66*a* is tightened by a fastener from the outside of the fixing belt 61 with the fixing belt 61 between the stationary part and the fastener, and then the fixing belt 61 and the end cap member 66 are strongly fitted with each other and fixed together at an entire peripheral surface of a joined surface between the outer peripheral surface of the stationary part 66*a* and the inner peripheral surface of the fixing belt 61.

According to this combining method of fixing the outer peripheral surface of the stationary part 66*a* and the inner peripheral surface of the fixing belt 61 together at the entire peripheral surface of the joined portion therebetween, the following effects can be obtained. That is, when an object to be rotatingly driven is formed of, for example, a member having a high strength or rigidity like a metallic cylindrical body, first, a groove or hole is formed in the cylindrical body and a protrusion formed in the end cap member 66 corresponding to the cylindrical body. Then, the protrusion of the end cap member 66 is fitted into the groove or the hole in the cylindrical body, thereby easily fixing the cylindrical body and the end cap member 66 together. Even by this fixing method, since the cylindrical body has a high strength or rigidity, a rotational driving force can be transmitted to the cylindrical body from the end cap member 66 without causing breakage, such as deformation or cracking, in the cylindrical body.

Meanwhile, in the fixing device 60 of the present embodiment, an object to be rotatingly driven is the thin-walled fixing belt 61 having a low strength or rigidity. Thus, in the partial combining method using a fitting portion between the groove or hole and the protrusion, the strength of the fixing belt 61 is likely to exceed its limit due to stress concentration at the fitting portion, which causes breakage, such as cracking, in the fixing belt 61. Therefore, there is a high probability that not only a rotational driving force cannot be efficiently transmitted to the fixing belt 61, but also rupture of the fixing belt 61 is finally caused, which makes the functions of the fixing belt disabled.

Meanwhile, if the combining method of the present embodiment is used, it is possible to configure the fixing device so that stress is not locally concentrated at a combined portion between the end cap member 66 and the fixing belt 61. That is, the fixing device is configured such that the entire peripheral surface of the joined portion between the outer peripheral surface of the stationary part 66*a* of the end cap member 66 and the inner peripheral surface of the fixing belt 61 are fixed together with, for example, adhesive so that a rotational driving force can be uniformly transmitted to the entire peripheral area of a joined surface between the end cap member 66 and the fixing belt 61. Therefore, even though the fixing belt 61 is a thin-walled member having a low strength or rigidity as a portion of a joined surface of the fixing belt 61, a rotational driving force can be stably and smoothly transmitted to the fixing belt 61 from the end cap member 66 without causing breakage, such as cracking, in the joined surface of the fixing belt 61.

In that case, since it can be supposed that a shearing force acting on the joined surface between the fixing belt 61 and the stationary part 66*a* of the end cap member 66 becomes large in proportion to an increase in rotation torque of the fixing belt 61 when the sliding resistance inside the fixing belt 61 deteriorates with use of an image forming apparatus for a prolonged period of time, an adhesive to be used is required to have an adhesive force which can endure such a large shearing force. Further, since it can be supposed that the temperature at the joined potion between the fixing belt 61 and the stationary part 66*a* rises up to about 200° C., the adhesives is also required to have heat resistance. Thus, in the fixing device 60 of the present embodiment, a heat-curable silicon-based adhesive having an allowable temperature limit of about 250° C. is used.

In this way, when the end cap member 66 and the fixing belt 61 is combined together by the combining method of the present embodiment, they can be combined together at both ends of the fixing belt 61 with adhesive.

Further, the following configuration can be employed. That is, the fixing belt 61 and the end cap member 66 is combined and fixed together at one end thereof using adhesive. Then, at the other end opposite to the one end, the stationary part 66*a* of the end cap member 66 is formed to have a slightly larger external diameter than the internal diameter of the fixing belt 61. In this state, the stationary part is fitted with the fixing belt 61 so as to push and widen the fixing belt, thereby fixing it. In this case, the fitting portion can be further tightened by a ring-shaped fastener. Although a combining force is decreased slightly when the stationary part 66*a* of the end cap member 66 is fitted to the fixing belt 61 and fixed thereto as described above, a sufficient driving transmission force can be transmitted to the entire peripheral area of the joined surface between the end cap member 66 and the fixing belt 61 by a frictional force so that stress is not concentrated on a portion of the joined surface while a rotational driving force from the end cap member 66 can be uniformly transmitted to the entire peripheral area.

Therefore, even if the combining methods of the present embodiment which are different from each other at both ends are used by fixing the fixing belt 61 and the end cap member 66 together at one end of the fixing belt 61 by using adhesive, and by fitting the fixing belt 61 with the end cap member 66 at the other end of the fixing belt to fix them together, a shearing force acting on both ends of the fixing belt 61 as a reaction force against a torque needed for driving the fixing belt 61 can be decentralized at the stationary part 66*a* of the end cap member 66 mounted on each of both ends of the fixing belt 61. Therefore, the fixing belt 61 can be rotatingly driven stably while the fixing belt 61 can be surely kept from being damaged due to a stress concentration.

Meanwhile, in the fixing device 60 of the present embodiment, the following manufacturing advantages can be obtained by fixing the fixing belt 61 and the end cap member 66 together at one end of the fixing belt 61 by the combining method using adhesive, and by fixing the fixing belt 61 and the end cap member 66 together at the other end of the fixing belt by the combining method using fitting.

Figure 7:
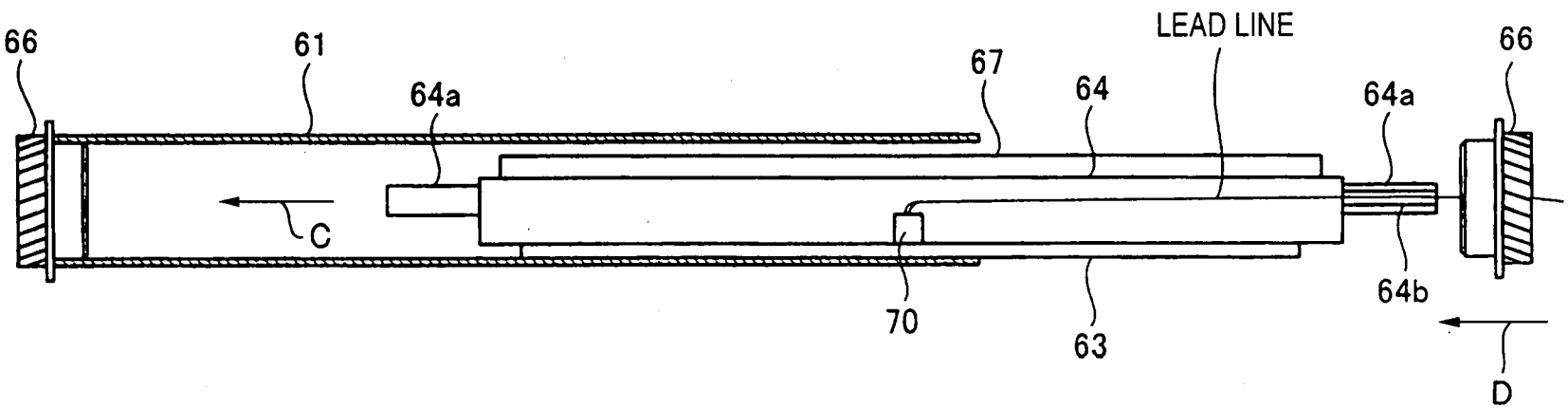
FIG. 7 is a view showing an assembling method when a pad supporting member is mounted inside the fixing belt.

FIG. 7 is a view showing an assembling method when the pad supporting member 64 having the pushing pad 63, the ferrite member 67, the temperature detecting sensor 70, and the like attached thereon is mounted inside the fixing belt 61. By employing this configuration, in the assembling process for mass production of fixing devices 60, first, the fixing belt 61 can be handled as one part in a state where the end cap member 66 is fixed to one end of the fixing belt 61 by the combining method using adhesive. Then, as shown in FIG. 7, the pad supporting member 64 having the pushing pad 63, the ferrite member 67, the temperature detecting sensor 70, and the like attached thereon is inserted into the fixing belt 61 adhered and fixed to the end cap member 66 from the end of the fixing belt to which the end cap member 66 is not adhered (a direction indicated by an arrow C). At this time, the shank 64*a* of the pad supporting member 64 is provided with the groove (recess) 64*b* which allows pass of a lead wire, so that the lead wire of the temperature detecting sensor 70 can be pulled out of the groove 64*b*. Then, the end cap member 66 is fitted into the end of the fixing belt 61 into which the end cap member 66 is to be fitted such that the end cap member pushes and widen an inner diameter of the fixing belt 61 slightly (in a direction indicated by an arrow D). At this time, since the lead wire of the temperature detecting sensor 70 passes through the inner diameter of the end cap member 66, the end cap member 66 is fitted with the fixing belt 61.

As described above, by fixing the end cap member 66 to one end of the fixing belt 61 with adhesive and by fitting and fixing the end cap member 66 to the other end of the fixing belt, a plurality of members can be easily assembled into the fixing belt 61. Thus, the assembling performance in mass production of fixing devices 60 can be improved.

Next, the gear tooth profile of the gear part 66*b* of the end cap member 66 will be described.

Figure 8A:
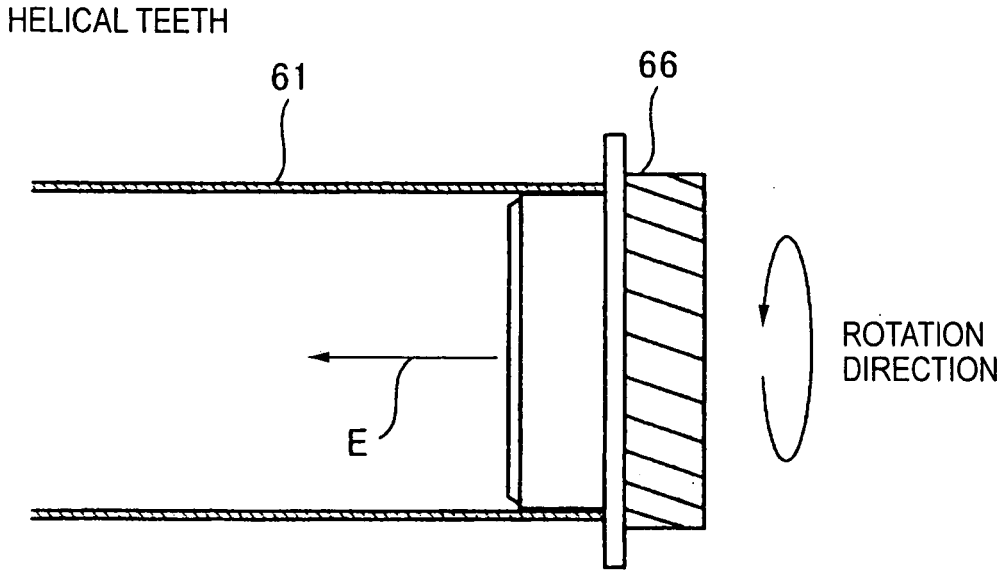
FIGS. 8A and 8B are views illustrating each state of the end cap member when the gear tooth profile of a gear part of the end cap member is formed of helical teeth and spur teeth.

In the fixing device 60 of the present embodiment, at least the end cap member 66 to be mounted at one end of the fixing belt where the fixing belt 61 and the end cap member 66 are fitted with each other and fixed together, has its gear teeth of the gear part 66*b* formed in the shape of helical teeth. Also, as shown in FIG. 8A, the direction of inclination of the gear teeth of the gear part 66*b* is set such that when a rotational driving force is transmitted from the transmission gear 85 in the rotation direction of the fixing belt 61 during normal fixing operation, the force can be applied in the direction in which the end cap member is fitted with the fixing belt 61 (direction toward a center portion of the fixing belt 61 in its width direction; direction indicated by an arrow E in the drawing).

Figure 8B:
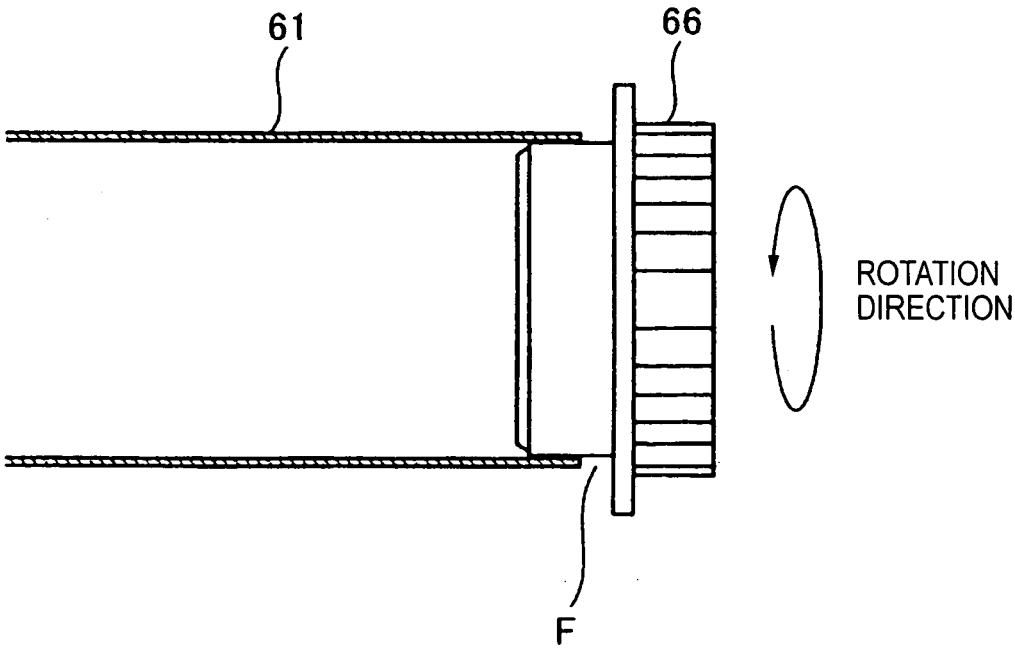

In this way, at least at the end of the fixing belt where the end cap member 66 is fitted and fixed, the direction of inclination of the gear part 66*b* is set as described above whereby the end cap member 66 fitted and fixed to the fixing belt always rotates while receiving a force directed to the center portion of the fixing belt 61 in its width direction during normal fixing operation. Therefore, unlike a case in which the gear teeth of the gear part 66*b* is formed in the shape of spur teeth (see FIG. 8B), it is possible to suppress occurrence of troubles such that the end cap member 66 drops out of the fixing belt 61 due to loosening of fitting between the end cap member 66 and the fixing belt 61 (a portion F in FIG. 8B), lubricant leaks from the inside due to occurrence of a gap between the end cap member 66 and the fixing belt 61, further the rotational speed of the fixing belt 61 is reduced due to an increase in torque caused by friction between the gear part 66*b* of the end cap member 66 and the frame 69, and the fixing belt 61 is buckled and finally broken.

Figure 9:
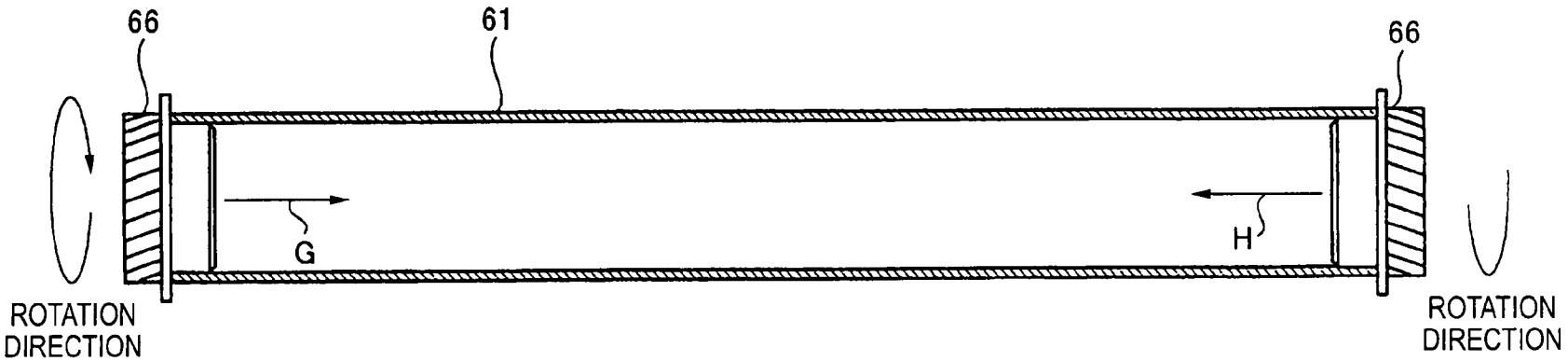
FIG. 9 is a view illustrating force acting on the end cap member when end cap members having a gear part formed of helical teeth are disposed at both ends of the fixing belt.

Moreover, as shown in FIG. 9, even at the end of the fixing belt where the fixing belt 61 and the end cap member 66 are fixed together by the combining method using adhesive, the gear teeth of the gear part 66*b* of the end cap member 66 are formed in the shape of helical teeth so that when a rotational driving force is transmitted from the transmission gear 84 in the rotation direction of the fixing belt 61 during normal fixing operation, the force can be applied in the direction in which the end cap member is fitted with the fixing belt 61 (direction toward a center portion of the fixing belt 61 in its width direction; direction indicated by arrows G and H in the drawing). Since this configuration allows generation of a force that pushes the fixing belt 61 against the other end of the fixing belt where the end cap member is fitted and fixed from the end of the fixing belt where the end cap member 66 is fixed using adhesive, fitting of the end cap member 66 at the end of the fixing belt where the end cap member is fitted and fixed is further hardly loosened. Moreover, since this configuration also allows generation of a force that pushes the fixing belt 61 against the end of the fixing belt where the end cap member 66 is fixed using adhesive from the end of the fixing belt where the end cap member 66 is fitted and fixed, the fixing belt 61 can be kept from being deviated from its predetermined axial position. Therefore, the fixing belt 61 can be stably located at its predetermined axial position, and occurrence of contact between the end cap member 66 and the frame 69 during rotation is suppressed so that the fixing belt can perform a stable rotational operation.

Further, even in the configuration where the fixing belt 61 and the end cap member 66 are fixed together at both ends of the fixing belt 61 by the combining method of the present embodiment using adhesive, the gear teeth of the gear part 66*b* of each end cap member 66 are formed in the shape of helical teeth, and the direction of the helical teeth can be set such that a force is applied in the direction in which the end cap member is fitted with the fixing belt 61 (direction toward a center portion of the fixing belt 61 in its width direction). Since this configuration allows forces to be applied to the fixing belt 61 from its both ends toward the center portion of the fixing belt 61 in its width direction, the fixing belt 61 can be kept from being deviated from its predetermined axial position. Therefore, the fixing belt 61 can be stably located at its predetermined axial position, and occurrence of contact between the end cap member 66 and the frame 69 during rotation is suppressed so that the fixing belt can perform a stable rotational operation.

Next, a configuration will be described in which the interior of the fixing belt 61 is sealed in a case where the stationary part 66*a* of the end cap member 66 is formed to have a slightly larger external diameter than the internal diameter of the fixing belt 61 and the end cap member 66 is fitted with and fixed to the fixing belt 61 so as to push and widen the fixing belt.

Meanwhile, as described above, lubricant is coated on the inner peripheral surface of the fixing belt 61 for the purpose of reducing a frictional force between the pushing pad 63 and the inner peripheral surface of the fixing belt 61. Therefore, in order to completely seal the fixing belt 61 to prevent the lubricant from leaking to the outside, when the end cap member 66 is fitted with the fixing belt 61 and fixed thereto, it is necessary to fix the fixing belt 61 and the end cap member 66 together while they are in close contact with each other, it is a matter of course that the interior of the fixing belt 61 can be sealed by fitting and fixing the end cap member 66. However, unlike the configuration in which the fixing belt 61 and the end cap member 66 are fixed together by the combining method of the present invention using adhesive, since a shielding wall such as adhesive shields the interior of the fixing belt 61 from the outside does not exist, the sealing performance of the fixing belt 61 sometimes becomes insufficient when fitting of the end cap member 66 is loosened slightly.

Figure 10:
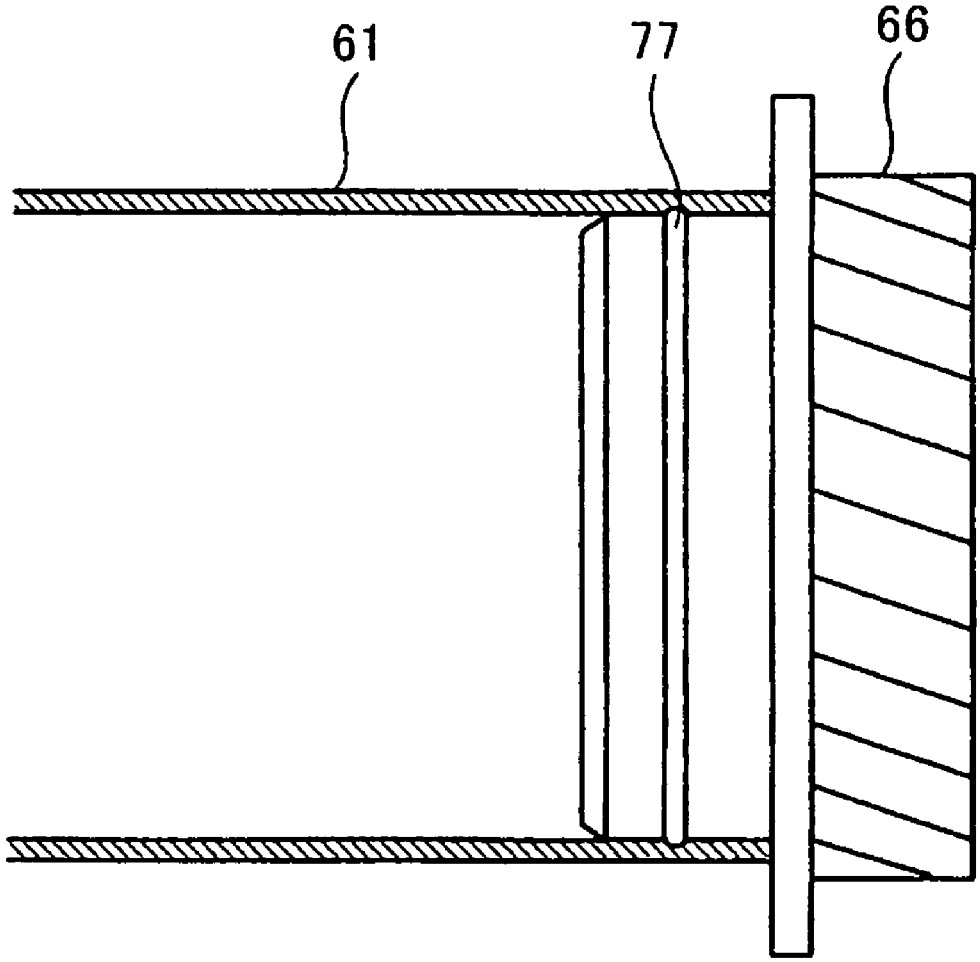
FIG. 10 is a view illustrating a configuration in which an oil-seal ring is disposed in the end cap member.

Thus, as shown in FIG. 10, one or a plurality of oil-seal rings 77 for suppressing leak of lubricant are disposed around the outer peripheral surface of the stationary part 66*a* at the end cap member 66 to be fitted and fixed. The disposition of the oil-seal rings 77 allows the oil-seal rings 77 to function as a shielding wall which shields the interior of the fixing belt 61 from the outside. Therefore, even in the case where the fitting of the end cap member 66 is loosened slightly, the sealing performance of the fixing belt 61 can be maintained, similar to the configuration in which the fixing belt 61 and the end cap member 66 are fixed together by the above-described combining method using adhesive.

Conventionally, as the lubricant to be coated on the fixing belt 61, amino-modified silicon oil, dimethyl silicon oil, and the like have been used. The viscosity of these oils is greater than 300 $mm^2/s$ at normal temperature (25° C.) and the viscosity thereof when being heated during fixing operation becomes 50 to 100 $mm^2/s$. However, as the lubricant, a lubricant of a lower viscosity has a greater effect of reducing a sliding torque of the fixing belt 61 as long as the lubricant is not volatilized during the fixing operation. Meanwhile, when a lubricant whose viscosity is below 300 $mm^2/s$ at normal temperature (25° C.) is used in a conventional fixing device in which the interior of the fixing belt 61 is not completely encapsulated, the leakage amount of the lubricant from the ends of the fixing belt 61 may increase. Therefore, oil having a higher viscosity than 300 $mm^2/s$ is commonly used. However, in the fixing device 60 of the present embodiment, since the sealing performance of the fixing belt 61 can be maintained even at the end cap member 66 to be fitted and fixed, the lubricant can be completely encapsulated inside the fixing belt 61. Therefore, leak of the lubricant is eliminated, and a lubricant whose viscosity is below 300 $mm^2/s$ at normal temperature (25° C.) and becomes a viscosity lower than 50 $mm^2/s$ during fixing operation can be used. As a result, the fixing belt 61 can be rotated with a torque lower than a conventional one, and the load of the driving motor 80 can also be reduced. Further, since depletion of lubricant due to the leak can be suppressed, a frictional force between the fixing belt 61 and the pushing pad 63 increases so that occurrence of slip between the fixing belt 61 and the pressing roller 62 and further between the fixing belt 61 and a paper P can be suppressed, and occurrence of image failures such as paper wrinkle or image shift can be suppressed. Moreover, soiling of a paper P due to leak of the lubricant or contamination within the apparatus can be prevented. Incidentally, the viscosity of the lubricant in the present embodiment is measured by a method defined JIS-Z8803.

As described above, the fixing device 60 of the present embodiment is configured such that when the fixing belt 61 and the end cap member 66 are combined together, the end cap member 66 and the fixing belt 61 is fixed on the entire peripheral surface of the joined surface between the outer peripheral surface of the stationary part 66*a* and the inner peripheral surface of the fixing belt 61.

Since this configuration allows a rotational driving force to be transmitted from the end cap member 66 can be uniformly transmitted to the entire peripheral surface of the joined surface between the end cap member 66 and the fixing belt 61, the rotational driving force can be stably and smoothly transmitted to the fixing belt 61 from the end cap member 66 without causing breakage such as cracking in the fixing belt 61 having low strength and rigidity and a small thickness.

Further, the following configuration can also be employed. That is, the fixing belt 61 and the end cap member 66 are fixed together at one end of the fixing belt 61 by the combining method of the present embodiment using adhesive, and the fixing belt 61 and the end cap member 66 are fitted with each other and fixed together at the opposite end to the one end by the combining method of the present embodiment. Even if the fixation is performed using the combining methods of the present embodiment which are different from each other at both ends in this way, a sufficient driving transmission force can be transmitted to the fixing belt 61 while the fixing belt equally receives a rotational driving force transmitted from the end cap member 66 so that stress is not locally concentrated. Further, since a plurality of members can be easily assembled into the fixing belt 61 by combining the fixing belt 61 and the end cap member 66 together by the fixation using adhesive at one side and by the fixation using fitting at the other side, the assemblability in mass production of fixing devices 60 can be improved.

Moreover, in the fixing device 60 of the present embodiment, at least the end cap member 66 to be mounted at one end of the fixing belt where the fixing belt 61 and the end cap member 66 are fitted with each other and fixed together, has its gear teeth of the gear part 66*b* formed in the shape of helical teeth. Also, the direction of inclination of the gear teeth of the gear part 66*b* is set such that when a rotational driving force is transmitted from the transmission gear 85 in the rotation direction of the fixing belt 61 during normal fixing operation, the force can be applied in the direction in which the end cap member is fitted with the fixing belt 61 (direction toward a center portion of the fixing belt 61 in its width direction). Therefore, since the end cap member 66 to be fitted and fixed rotates while always receiving a force toward the center portion of the fixing belt 61 in its width direction during normal fixing operation, at least at the end of the fixing belt where the end cap member 66 is fitted and fixed, it is possible to suppress occurrence of troubles such that the end cap member 66 drops out of the fixing belt 61, lubricant leaks from the inside due to occurrence of a gap between the end cap member 66 and the fixing belt 61, further the rotational speed of the fixing belt 61 is reduced due to an increase in torque caused by friction between the gear part 66*b* of the end cap member 66 and the frame 69, and the fixing belt 61 is buckled and finally broken.

In addition, even at the end of the fixing belt where the fixing belt 61 and the end cap member 66 are fixed together by the combining method using adhesive, the gear teeth of the gear part 66*b* of the end cap member 66 are formed in the shape of helical teeth so that when a rotational driving force is transmitted from the transmission gear 84 in the rotation direction of the fixing belt 61 during normal fixing operation, the force can be applied in the direction in which the end cap member is fitted with the fixing belt 61 (direction toward the center portion of the fixing belt 61 in its width direction) This allows the fixing belt 61 to be stably located at its predetermined axial position. As a result, occurrence of contact between the end cap member 66 and the frame 69 during rotation is suppressed so that the fixing belt can perform a stable rotational operation.

Further, even in the configuration where the fixing belt 61 and the end cap member 66 are fixed together at both ends of the fixing belt 61 by the combining method of the present embodiment using adhesive, the gear teeth of the gear part 66*b* of each end cap member 66 are formed in the shape of helical teeth, and the direction of the helical teeth can be set such that a force is applied in the direction in which the end cap member is fitted with the fixing belt 61 (direction toward a center portion of the fixing belt 61 in its width direction). Since this configuration allows forces to be applied to the fixing belt 61 from its both ends toward the center portion of the fixing belt 61 in its width direction, the fixing belt 61 can be kept from being deviated from its predetermined axial position. Therefore, the fixing belt 61 can be stably located at its predetermined axial position, and occurrence of contact between the end cap member 66 and the frame 69 during rotation is suppressed so that the fixing belt can perform a stable rotational operation.

Moreover, in the fixing device 60 of the present embodiment, since the sealing performance of the fixing belt 61 can be maintained even, the lubricant can be completely encapsulated inside the fixing belt 61. Therefore, leak of the lubricant is eliminated, and a lubricant having a viscosity of 300 $mm^2/s$ or less can be used. As a result, the fixing belt 61 can be rotated with a torque lower than a conventional one, and the load of the driving motor 80 can also be reduced. Further, since depletion of lubricant due to the leak can be suppressed, a frictional force between the fixing belt 61 and the pushing pad 63 increases so that occurrence of slip between the fixing belt 61 and the pressing roller 62 and further between the fixing belt 61 and a paper P can be suppressed, and occurrence of image failures such as paper wrinkle or image shift can be suppressed. Moreover, soiling of a paper P due to leak of the lubricant or contamination within the apparatus can be prevented.

SECOND EMBODIMENT

In the first embodiment, the image forming apparatus has been described that is equipped with the fixing device 60 using the electromagnetically induced heating member 65 as a heating means which heats the fixing belt 61 in an electromagnetically induced heating manner. In second embodiment, a fixing device will be described which uses a heating source, such as a halogen lamp, as a heating means in the fixing device to be mounted on the image forming apparatus shown in FIG. 1. Incidentally, elements similar to those in first embodiment are designated by similar numerals, and thus the detailed description thereof will be omitted herein.

Figure 11:
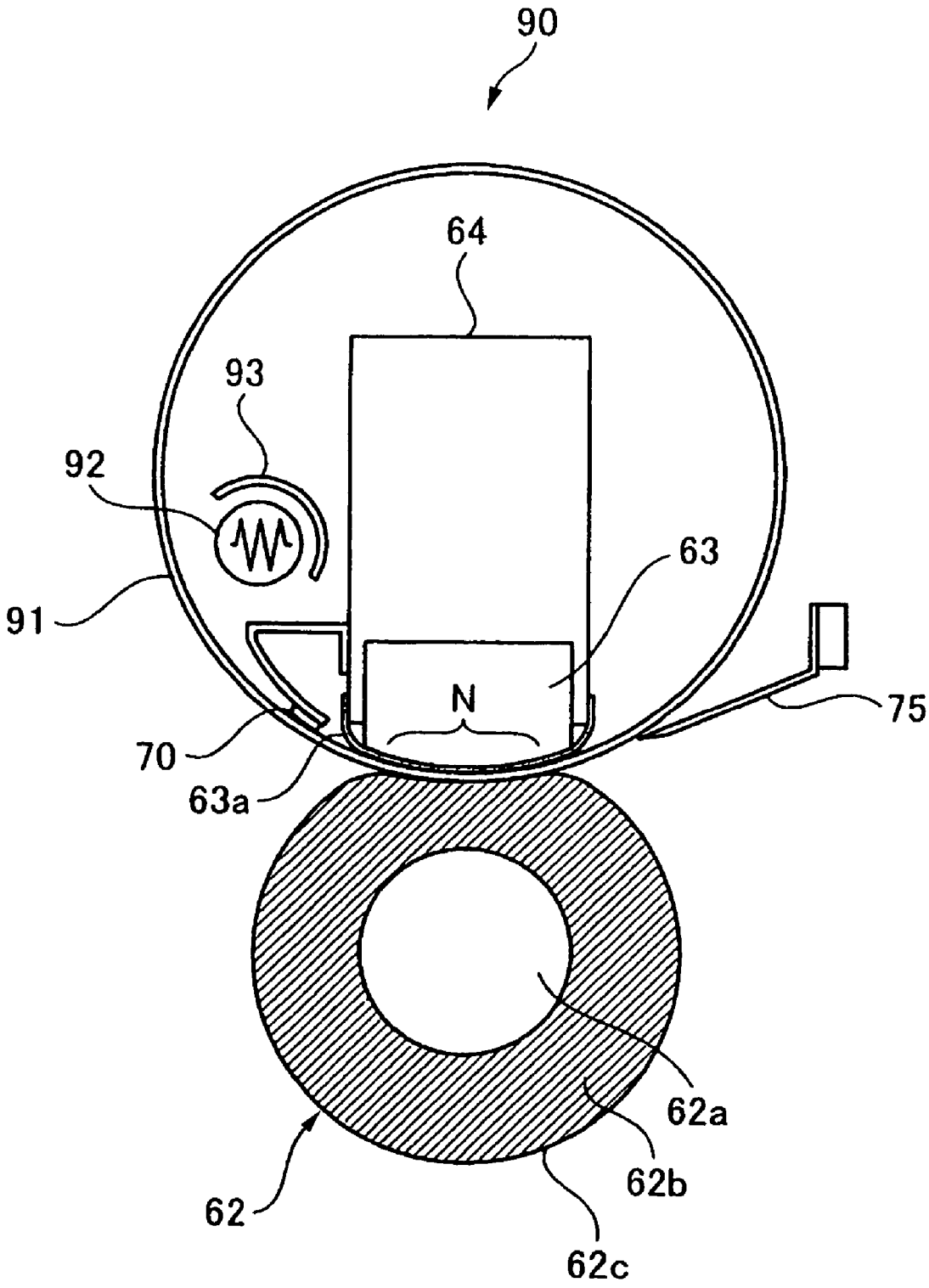
FIG. 11 is a schematic cross-sectional view showing a configuration of a fixing device according to a second embodiment.

FIG. 11 is a schematic cross-sectional view showing a configuration of the fixing device 90 according to second embodiment. In the fixing device 90 of the present embodiment, a fixing belt 91 is configured such that a base layer, an elastic layer, and a surface release layer serving as an outer peripheral surface are laminated. Further, as the heating source which heats the fixing belt 91, for example, a halogen lamp 92 of 600 W is used. Heat radiated from the halogen lamp 92 is collected on the fixing belt 91 by a condensing plate 93. Incidentally, as the heating source, a sheet heating element can be adapted to contact an inner peripheral surface of the fixing belt 91.

Even in the fixing device 90 having such a configuration, when the fixing belt 91 and the end cap member 66 (not shown in FIG. 11) are combined together, the end cap member 66 and the fixing belt 91 are adapted to be fixed on the entire peripheral surface of the joined surface between the outer peripheral surface of the stationary part 66*a* (not shown in FIG. 11) and inner peripheral surface of the fixing belt 91.

Further, a configuration can also be employed in which fixation is performed by the combining methods which are different from each other at both ends such that the fixing belt 91 and the end cap member 66 are fixed together at one end of the fixing belt 91 by the combining method using adhesive, similar to first embodiment, and the fixing belt 91 and the end cap member 66 are fitted with each other and fixed together at the opposite end to the one end by the combining method using fitting and fixing.

Moreover, at least the end cap member 66 to be mounted at one end of the fixing belt where the fixing belt 91 and the end cap member 66 are fitted with each other and fixed together, has its gear teeth of the gear part 66*b* (not shown in FIG. 11) formed in the shape of helical teeth. Also, the direction of inclination of the gear teeth of the gear part 66*b* is set such that when a rotational driving force is transmitted from the transmission gear 85 (see FIG. 2) in the rotation direction of the fixing belt 91 during normal fixing operation, the force can be applied in the direction in which the end cap member is fitted with the fixing belt 91 (direction toward a center portion of the fixing belt 91 in its width direction). In this case, the end cap member 66 to be mounted at the end of the fixing belt where the fixing belt 91 and the end cap member 66 are fixed together by the above-described combining method using adhesive can be configured similarly.

In addition, the fixing belt 91 and the end cap member 66 are adapted to be fixed together at both ends of the fixing belt 91 by the above-described combining method using adhesive, the gear teeth of the gear part 66*b* of the end cap member 66 are formed in the shape of helical teeth, and the direction of the helical teeth can be set so that a force is applied in the direction in which the end cap member is fitted with the fixing belt 91 (direction toward the center portion of the fixing belt 91 in its width direction).

By such configurations, the fixing device 90 of the present embodiment can also exhibit the effects similar to those in first embodiment.

As examples which utilize the invention, there are an application to image forming apparatuses, such as copying machines or printers, which use an electrophotographic method and an application to fixing devices which fix, for example, an unfixed toner image carried on a recording sheet. There are also an application to image forming apparatuses, such as copying machines or printers, which use an inkjet method and an application to fixing devices which dry, for example, an undried ink image carried on a recording sheet.

As described with reference to the embodiments, there is provided a fixing device including: a fixing belt member configured to be endless and rotatable; driving force transmission members that are disposed on respective ends of the fixing belt member, and transmit a rotational driving force to the fixing belt member; and a pressing member that is disposed to push an outer surface of the fixing belt member and forms a fixing nip part between the pressing member and the fixing belt member, wherein each of the driving force transmission members is fixed to the fixing belt member over an entire peripheral area of the corresponding end of the fixing belt member.

Each of the driving force transmission member may be formed in a substantially cylindrical shape such that a portion thereof is inserted into and disposed in the fixing belt member, and a section thereof in a plane orthogonal to a width direction of the fixing belt member is maintained in a substantially a circular shape. Further, the driving force transmission members may be fixed to the fixing belt member by adhesive at one end of the fixing belt member, and be fixed to the fixing belt member by fitting at the other end of the fixing belt member. In particular, in the driving force transmission members, the driving force transmission member fixed to the fixing belt member by fitting may have a helical gear that is formed so as to apply a force toward a middle portion of the fixing belt member in its width direction by rotation during fixing operation. In addition, in the driving force transmission members, the driving force transmission member fixed to the fixing belt member by adhesive may have a helical gear that is formed so as to apply a force toward a middle portion of the fixing belt member in its width direction by rotation during fixing operation.

Moreover, the driving force transmission member may be fixed to both ends of the fixing belt member by adhesive. In particular, the driving force transmission members may have a helical gear that is formed so as to apply a force toward a middle portion of the fixing belt member in its width direction by rotation during fixing operation.

Further, according to another aspect of the invention, the fixing device includes a rotatable endless fixing belt member made of a flexible material; driving force transmission members disposed at both ends of the fixing belt member to transmit a rotational driving force to the fixing belt member; a supporting member that pivotally supports the driving force transmission member; and a pressing roller member that is disposed to push an outer surface of the fixing belt member and rotates to follow the fixing belt member and forms a fixing nip part between the pressing member and the fixing belt member. The driving force transmission members are mounted so as to seal the interior of the fixing belt member from the outside.

The driving force transmission member may be fixed to the fixing belt member by adhesive over an entire peripheral area of the fixing belt member at least at one end of the fixing belt member. Further, the driving force transmission members may be formed so as to apply a force to the fixing belt member toward a middle portion of the fixing belt member in its width direction by rotation during fixing operation. Further, an inner peripheral surface of the fixing belt member may be coated with a lubricant having a viscosity of 300 $mm^2/s$ or less. In addition, the supporting member is formed with a recess which allows pass of a lead wire between the interior and exterior of the fixing belt member.

Further, according to still another aspect of the invention, an image forming apparatus includes a toner image forming means that forms a toner image; a transfer means that transfers the toner image formed by the toner image forming means onto a recording material; a fixing unit that fixes the toner image transferred onto the recording material on the recording material; and a driving unit that drives the fixing unit. The fixing unit have a rotatable endless fixing belt member made of a flexible material; driving force transmission members disposed at ends of the fixing belt member to transmit a rotational driving force to the fixing belt member; and a pressing roller member that is disposed to push an outer surface of the fixing belt member and forms a fixing nip part between the pressing member and the fixing belt member. The driving force transmission members have a stationary part that is inserted into and disposed in the fixing belt member and fixed to the fixing belt member over an entire peripheral area of the fixing belt member, and a gear part that receives the rotational driving force from the driving unit.

Here, in the fixing unit, the fixing belt may be fixed to the stationary part of one of the driving force transmission members by adhesive at least at one end of the fixing belt member. Further, in the fixing unit, the fixing belt member is fixed to the stationary part of one of the driving force transmission members by fitting at least at one end of the fixing belt member, and the gear part of each of the fixing belt members is formed of a helical gear that applies a force to the fixing belt member toward a middle portion of the fixing belt member in its width direction during operation of the fixing unit.

As described with reference to the embodiments, since occurrence of rupture in a fixing belt member can be suppressed to stably drive the fixing belt member, the rotational speed of the fixing belt member can be stabilized. Also, occurrence of disturbance in a fixed image and paper wrinkle of a recording paper can be suppressed to provide a high-quality fixed image for a prolonged period of time.

Although the present invention has been shown and described with reference to the embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A fixing device comprising:

a fixing belt member configured to be endless and rotatable;

driving force transmission members that are disposed on respective ends of the fixing belt member, and transmit a rotational driving force to the fixing belt member; and a pressing member that is disposed to push an outer surface of the fixing belt member to form a fixing nip part between the pressing member and the fixing belt member, wherein each of the driving force transmission members is frictionally fixed to the inner peripheral surface of the fixing belt member over an entire peripheral area of the corresponding end of the fixing belt member, and each of the driving force transmission members comprises a helical gear that is formed to apply a force toward a center portion of the fixing belt member in a width direction of the fixing belt member by rotation during a fixing operation.

2. The fixing device according to claim 1, wherein the driving force transmission members are formed in a substantially cylindrical shape such that a portion thereof is inserted into and disposed in the fixing belt member, and a section of the fixing belt member in a plane orthogonal to a width direction thereof is maintained in a substantially circular shape.

3. The fixing device according to claim 1 further comprising an electromagnetically induced heating member that applies heat to the fixing belt member.

4. A fixing device comprising:

a fixing belt member configured to be endless and rotatable, and made of a flexible material;

driving force transmission members that are disposed on respective ends of the fixing belt member, and transmit a rotational driving force to the fixing belt member;

a supporting member that pivotally supports the driving force transmission member; and a pressing member that is disposed to push an outer surface of the fixing belt member and rotates to follow rotation of the fixing belt member, the pressing member forming a fixing nip part between the pressing member and the fixing belt member, wherein the driving force transmission members are mounted so as to seal an interior of the fixing belt member from outside, each of the driving force transmission members comprises a helical gear that is formed to apply a force toward a center portion of the fixing belt member in a width direction of the fixing belt member by rotation during a fixing operation.

5. The fixing device according to claim 4, wherein the driving force transmission members are fixed to the fixing belt member by adhesive over an entire peripheral area of the fixing belt member at least at one end of the fixing belt member.

6. The fixing device according to claim 4, wherein an inner peripheral surface of the fixing belt member is coated with a lubricant having a viscosity of 300 $mm^2/s$ or less.

7. The fixing device according to claim 4, wherein the supporting member is formed with a recess that allows a lead wire to pass through between an interior and an exterior of the fixing belt member.

8. An image forming apparatus comprising:

a toner image forming unit that forms a toner image;

a transfer unit that transfers the toner image formed by the toner image forming unit onto a recording medium;

a fixing unit that fixes the toner image transferred onto the recording medium on the recording medium; and a driving unit that drives the fixing unit, wherein the fixing unit includes:

a fixing belt member configured to be endless and rotatable, and made of a flexible material;

driving force transmission members that are disposed on respective ends of the fixing belt member, and transmit a rotational driving force to the fixing belt member;

a supporting member that pivotally supports the driving force transmission member; and a pressing member that is disposed to push an outer peripheral surface of the fixing belt member and rotates to follow rotation of the fixing belt member, wherein a fixing nip part is formed between the pressing member and the fixing belt member, wherein each of the driving force transmission members have a stationary part that is inserted into and disposed in the fixing belt member and frictionally fixed to the inner peripheral surface of the fixing belt member over an entire peripheral area of the corresponding end of the fixing belt member, a gear part that receives the rotational driving force from the driving unit, and the gear part of each of the driving force transmission members is formed of a helical gear that applies a force to the fixing belt member toward a center portion of the fixing belt member in its width direction during operation of the fixing unit.

9. The image forming apparatus according to claim 8, wherein the fixing belt member is fixed to the stationary part of one of the driving force transmission members by fitting at least at one end of the fixing belt member.

10. The image forming apparatus according to claim 8, wherein the fixing device further includes an electromagnetically induced heating member for heating the fixing belt member.

11. A fixing device, comprising:

a fixing belt member configured to be endless and rotatable, and made of a flexible material;

driving force transmission members that are disposed on respective ends of the fixing belt member, and transmit a rotational driving force to the fixing belt member;

a supporting member that pivotally supports the driving force transmission member;

a pressing member that is disposed to push an outer surface of the fixing belt member and rotates to follow rotation of the fixing belt member, the pressing member forming a fixing nip part between the pressing member and the fixing belt member; and a seal ring disposed between an outer surface of a stationary portion of at least one of the driving force transmission members and an inner surface of the fixing belt member, wherein the driving force transmission members are mounted so as to seal an interior of the fixing belt member from outside.

12. A fixing device, comprising:

a fixing belt member configured to be endless and rotatable;

driving force transmission members that are disposed on respective ends of the fixing belt member, and transmit a rotational driving force to the fixing belt member; and a pressing member that is disposed to an outer surface of the fixing belt member to form a fixing nip part between the pressing member and the fixing belt member, wherein each of the driving force transmission members is fixed by an adhesive to the inner peripheral surface of the fixing belt member over an entire peripheral area of the corresponding end of the fixing belt member, and each of the driving force transmission members comprises a helical gear that is formed to apply a force toward a center portion of the fixing belt member in a width direction of the fixing belt member by rotation during a fixing operation.

13. The fixing device according to claim 12, wherein:

one of the driving force transmission members is fixed to the fixing belt member by the adhesive at one end of the fixing belt member, and the other of the driving force transmission members is fixed to the fixing belt member by fitting at the other end of the fixing belt member.

14. The fixing device according to claim 12, wherein both of the driving force transmission members are fixed to the respective ends of the fixing belt member by the adhesive.

15. An image forming apparatus, comprising:

a toner image forming unit that forms a toner image;

a transfer unit that transfers the toner image formed by the toner image forming unit onto a recording medium;

a fixing unit that fixes the toner image transferred onto the recording medium on the recording medium; and a driving unit that drives the fixing unit, wherein the fixing unit includes:

a fixing belt member configured to be endless and rotatable, and made of a flexible material;

driving force transmission members that are disposed on respective ends of the fixing belt member, and transmit a rotational driving force to the fixing belt member;

a supporting member that pivotally supports the driving force transmission member; and a pressing member that is disposed to push an outer surface of the fixing belt member and rotates to follow rotation of the fixing belt member, the pressing member forming a fixing nip part between the pressing member and the fixing belt member, wherein each of the driving force transmission members have a stationary part that is inserted into and disposed in the fixing belt member and fixed by an adhesive to the inner peripheral surface of the fixing belt member over an entire peripheral area of the corresponding end of the fixing belt member, a gear part that receives the rotational driving force from the driving unit, and the gear part of each of the driving force transmission members is formed of a helical gear that applies a force to the fixing belt member toward a center portion of the fixing belt member in its width direction during operation of the fixing unit.

16. The image forming apparatus according to claim 15, wherein the fixing belt is fixed to the stationary part of one of the driving force transmission members by the adhesive at least at one end of the fixing belt member.

* * * * *